US005435496A

United States Patent [19]

Kanda et al.

[11] Patent Number: 5,435,496

[45] Date of Patent: Jul. 25, 1995

[54] COLLISION-TYPE GAS CURRENT PULVERIZER AND METHOD FOR PULVERIZING POWDERS

[75] Inventors: Hitoshi Kanda, Yokohama; Masayoshi Kato, Iruma; Satoshi Mitsumura, Tokyo; Yusuke Yamada, Machida; Yasuhide Goseki, Yokohama, all of Japan

[73] Assignee: Canon Kabushiki Kaisha, Tokyo, Japan

[21] Appl. No.: 178,849

[22] Filed: Jan. 7, 1994

Related U.S. Application Data

[60] Division of Ser. No. 983,287, Nov. 30, 1992, Pat. No. 5,316,222, which is a continuation of Ser. No. 575,371, Aug. 30, 1990, abandoned.

[30] Foreign Application Priority Data

| | | | |
|---|---|---|---|
| Aug. 30, 1989 | [JP] | Japan | 1-221805 |
| Sep. 22, 1989 | [JP] | Japan | 1-245215 |
| Dec. 7, 1989 | [JP] | Japan | 1-316525 |
| Jan. 9, 1990 | [JP] | Japan | 2-1102 |
| Jan. 17, 1990 | [JP] | Japan | 2-6459 |

[51] Int. Cl.[6] ..... B02C 19/00

[52] U.S. Cl. ..... 241/5; 241/23

[58] Field of Search ..... 241/5, 39, 40, 23

[56] References Cited

U.S. PATENT DOCUMENTS

| | | | |
|---|---|---|---|
| 251,803 | 1/1882 | Starkey | 241/40 X |
| 2,119,887 | 6/1938 | Myers | 83/46 |
| 2,765,122 | 10/1956 | Trost | 241/40 |
| 2,776,799 | 1/1957 | Spitz et al. | 241/40 |
| 2,821,346 | 1/1958 | Fisher | 241/39 |
| 3,312,342 | 4/1967 | Brown | 209/3 |
| 3,482,786 | 12/1969 | Hogg | 241/40 X |
| 3,602,439 | 8/1971 | Nakayama | 241/39 |
| 4,304,360 | 12/1981 | Luhr et al. | 241/5 |
| 4,451,005 | 5/1984 | Urayama | 241/40 |
| 4,784,333 | 11/1988 | Hikake et al. | 241/5 |
| 4,792,098 | 12/1988 | Haddow | 241/5 |
| 4,930,707 | 6/1990 | Oshiro et al. | 241/5 |
| 5,016,823 | 5/1991 | Kato et al. | 241/5 |
| 5,316,222 | 5/1994 | Kanda et al. | 241/5 |

FOREIGN PATENT DOCUMENTS

| | | |
|---|---|---|
| 2619320 | 2/1989 | France . |
| 46-22778 | 6/1971 | Japan . |
| 1449162 | 1/1989 | U.S.S.R. . |

OTHER PUBLICATIONS

Patent Abstracts of Japan, vol. 14, No. 7, Jan. 10, 1990, Japanese Document No. 1-254266 (Nov. 1989).

Derwent Publications Ltd., No. 8942, Nov. 29, 1989, Soviet Abstract, No. SU 1449-162 (Nov. 1989).

*Primary Examiner*—Frances Han

*Attorney, Agent, or Firm*—Fitzpatrick, Cella, Harper & Scinto

[57] ABSTRACT

A pneumatic pulverizer comprises an acceleration pipe for transporting powders under acceleration by a high pressure gas, a pulverization chamber, a collision member for pulverizing the powders ejected from the acceleration pipe by a force of collision, the collision member being provided against the outlet of the acceleration pipe, a raw material powder supply inlet provided on the acceleration pipe, and a secondary air inlet provided between the raw material powder supply inlet and the outlet of the acceleration pipe.

21 Claims, 11 Drawing Sheets

COLLISION-TYPE GAS CURRENT PULVERIZER AND METHOD FOR PULVERIZING POWDERS

This application is a division of application Ser. No. 07/983,287, filed Nov. 30, 1992, now U.S. Pat. No. 5,316,222, which is a continuation of application Ser. No. 07/575,371, filed Aug. 30, 1990, now abandoned.

BACKGROUND OF THE INVENTION

1. Field of the Invention

This invention relates to a collision-type gas current pulverizer and a method for pulverizing powders, using a jet gas current (pressurized gas), and more particularly to a collision-type gas current pulverizer and a method for pulverizing powders for efficiently forming toners or color resin powders for the toners for use in the image formation by electrophotography.

2Related Background Art

A collision-type gas current pulverizer using a jet gas current is used to transport a powdery raw material with a jet gas current and allow the powdery raw material to collide with a colliding member, thereby pulverizing the powdery raw material by the force of collision.

A conventional collision-type, gas current pulverizer will be explained below, referring to FIG. 4.

A collision member 4 is provided against the outlet 13 of an acceleration pipe 43 connected to a compressed gas supply nozzle 2, and a powdery raw material is introduced into the acceleration pipe 43 from a powdery raw material hopper 1 in communication with the middle of the acceleration pipe 43 by suction generated by high speed flow of a high pressure gas supplied to the acceleration pipe 43 and ejected at the outlet 13 together with the high pressure gas, thereby subjecting the powdery raw material to collision with the collision member 4 and pulverizing the powdery raw material into finer powders through the collision. In order to pulverize the powdery raw material to a desired particle size, a classifier is provided between the powdery raw material hopper 1 and a discharge outlet 5 and is supplied with the powder from the pulverizer, and the classified coarse powders is supplied to the pulverizer through the powdery raw material hopper 1 and pulverized. The resulting pulverization product is returned to the classifier from the discharge outlet 5 to repeat the classification. Finer powders classified by the classifier are a finely pulverized product with the desired particle size.

However, in the foregoing prior art example, it is difficult to thoroughly disperse the powdery raw material introduced into the acceleration pipe by suction in the high pressure gas current, and thus the powder stream ejected at the outlet of the acceleration pipe contains a thick stream portion with a high powder concentration and a thin stream portion with a low powder concentration. Thus, the powder stream unevenly collides with the collision member counterposed to the outlet of the acceleration pipe, resulting in a decrease in the pulverization efficiency, which leads to a decrease in the powder-treating capacity. When the powder-treating capacity is to be increased in that state, the powder concentration in a pulverizing chamber 8 is partially increased, thereby making the powder stream uneven.

That is, the pulverization efficiency is lowered thereby.

Particularly in the case of resin-containing powders, a fusion product is unpreferably formed on the surface of the collision member.

In order to increase the pulverization efficiency of powder particles in the acceleration pipe 43, a pulverization pipe is proposed in Japanese Patent Publication No. 46-22778, which is provided with a high pressure gas feed pipe for ejecting a secondary high pressure gas at the position just before the outlet of acceleration pipe 43. The proposed pulverization pipe is directed to promotion of collision in the acceleration pipe and is a useful means for a pulverizer that conducts pulverization only in the acceleration pipe, but not a useful means for a collision-type, gas current pulverizer that conducts pulverization through collision with the colliding member, because the introduction of a secondary high pressure gas for promotion of collision in the acceleration pipe 43 impairs a transporting stream of the high pressure gas introduced from the compressed gas supply nozzle, thereby lowering the speed of the powder stream ejected at the outlet 13 of the acceleration pipe 43. Thus, the force of collision on the colliding member 4 is lowered and, also the pulverization efficiency is unpreferably lowered. In other words, a pulverizer with a good pulverization efficiency and a method for pulverization has been keenly desired.

On the other hand, toners and color resin powders for the toners for use in a process for forming an image by electrophotography usually contain at least a binder resin and a coloring agent or magnetic powders. The toners develop an electrostatically charged image formed on a latent image carrier, and the thus formed toner image is transferred onto a transfer material such as plain paper or a plastic film. The toner image on the transfer material is fixed to the transfer material by a fixing apparatus such as a heat fixing means, a pressure roller fixing means or a heat-pressure roller fixing means. Thus, the binder resin for use in the toners has such a characteristic as to undergo a plastic deformation when heat and/or a pressure is applied thereto.

Now, toners or color resin powders for the toners are prepared by fusion-kneading a mixture comprising at least a binder resin and a coloring agent or magnetic powders (and, if necessary, a third component) and cooling the fusion-kneaded product, followed by pulverization and classification. That is, the cooled product is usually subjected to coarse pulverization (or intermediate pulverization) by a mechanical, impact-type pulverizer (crusher) and the coarse pulverized powders are then subjected to fine pulverization by a collision-type, gas current pulverizer using a jet gas current.

When the pulverization capacity is to be increased in the conventional collision-type, gas current pulverized and the method for pulverization, as shown in FIG. 4, a fusion product is formed on the surface of colliding member 14, resulting in failure to stably produce the toners. Thus, an efficient collision-type, gas current pulverizer and a pulverization method for efficiently producing toners or color resin powders for the toners for use in the image formation by electrophotography, free from the foregoing problems, have been keenly desired.

SUMMARY OF THE INVENTION

An object of the present invention is to provide an efficient collision-type, gas current pulverizer and a method for pulverization, free from the foregoing problems.

Another object of the present invention is to provide a collision-type, gas current pulverizer and a method for pulverization, which can efficiently pulverize powders composed mainly of a thermoplastic resin.

Another object of the present invention is to provide a collision-type, gas current pulverizer, which can efficiently produce toners or color resin powders for use in a copying machine and a printer having a heat-pressure roller fixing means.

A further object of the present invention is to provide a collision-type, gas current pulverizer, which can efficiently pulverize resin particles having an average particle size of 20 to 2,000 μm to fine powders having an average particle size of 3 to 15 μm.

Still a further object of the present invention is to provide a collision-type, gas current pulverizer and a method for pulverization, which can efficiently pulverize pulverizable materials composed mainly of a thermoplastic resin such as polyester-based or styrene-based resin.

A still further object of the present invention is to provide a collision-type, gas current pulverizer and a method for pulverization, which can hardly form fusion of the pulverizable materials and pulverized product in a pulverization chamber or can suppress fusion of the pulverizable materials and pulverized product with less production of aggregates and coarse particles, even if the treating rate of the pulverizable materials is increased.

Still a further object of the present invention is to provide a method for producing toners for developing an electrostatically charged image with good properties due to a finely pulverized product with a restricted particle size distribution.

Still a further object of the present invention is to provide a method for efficiently producing toners of small particle sizes for developing an electrostatically charged image.

Still a further object of the present invention is to provide a pneumatic pulverizer comprising an acceleration pipe for transporting powders under acceleration by a high pressure gas, a pulverization chambers, a collision member for pulverizing the powders ejected from the acceleration pipe by the force of collision, the collision member being provided against the outlet of the acceleration pipe, a raw material powder supply inlet being provided at the acceleration pipe, and a secondary air inlet being provided between the raw material powder supply inlet and the outlet of the acceleration pipe.

Still a further object of the present invention is to provide a pulverizing method comprising transporting powders under acceleration by a high pressure gas through an acceleration pipe, while introducing a secondary air into the acceleration pipe, and discharging the powders into a pulverization chamber at the outlet of the acceleration pipe, and allowing the powders to collide with a collision member counterposed to the outlet, thereby pulverizing the powders.

Still a further object of the present invention is to provide a pneumatic pulverizing system comprising a pneumatic pulverizer, a gas current classifying separator, a communication means for introducing the powders pulverized in the pneumatic pulverizer into the gas current classifying separator, and another communication means for introducing coarse powders classified in the gas current classifying separator into the pneumatic pulverizer together with the raw material powder. The pneumatic pulverizer comprises an acceleration pipe for transporting powders under acceleration by a high pressure gas, a pulverization chamber, a collision member for pulverizing the powders ejected from the acceleration pipe by a force of collision, the collision member being provided against the outlet of the acceleration pipe, a raw material powder supply inlet being provided at the acceleration pipe, and a secondary air inlet being provided between the raw material powder supply inlet and the outlet of the acceleration pipe.

Still a further object of the present invention is to provide a process for producing a toner for developing an electrostatic image, comprising kneading a composition containing at least a binder resin and a coloring agent under fusion, cooling and solidifying the kneading, pulverizing the solidified product by a mechanical pulverizing means, further pulverizing the resulting first pulverized product by a pulverizing means including a collision-type, gas current pulverizer, classifying the resulting second pulverized product by a gas current classifying separator, and withdrawing the thus classified fine powders from the classifying separator, thereby obtaining the toner; The thus classified coarse powders are introduced into the collision-type, gas current pulverizer again together with the first pulverized product, the gas current classifying separator comprising a powder inlet cylinder, an annular guide chamber communicated with the powder inlet cylinder, a classification chamber, a plurality of louvers provided between the guide chamber and the classification chamber, ends of the individual louvers being arranged in a tangential direction to the inner peripheral circle of the guide chamber, an inclined classifying plate provided at the bottom of the classification chamber, the inclined classifying plate being elevated towards the center and having a discharge outlet at the center, a plurality of classifying louvers provided at the bottom of the classification chamber and around the inclined classifying plate, a fine powder discharge chute connected to the discharge outlet, and a coarse powder discharge outlet provided around and at the bottom of The classifying plate, the second pulverized product is supplied together with a carrier air into the classification chamber being subjected to a whirling flow by an air stream introduced through the classifying lowers, thereby centrifugally separating the second pulverized product into fine powders and coarse powders, and the fine powders being discharged through the fine powder discharge chute, whereas the coarse powders are discharged through the coarse powder discharge outlet, and the collision-type gas current pulverizer comprising an acceleration pipe for transporting powders under acceleration by a high pressure gas, a pulverization chamber, a collision member for pulverizing the powders ejected from the acceleration pipe by a force of collision, the collision member being provided against the outlet of the acceleration pipe, a raw material powder supply inlet being provided at the acceleration pipe, and a secondary air inlet being provided between the raw material powder supply inlet and the outlet of the acceleration pipe.

BRIEF DESCRIPTION THE DRAWINGS

Figure 9:
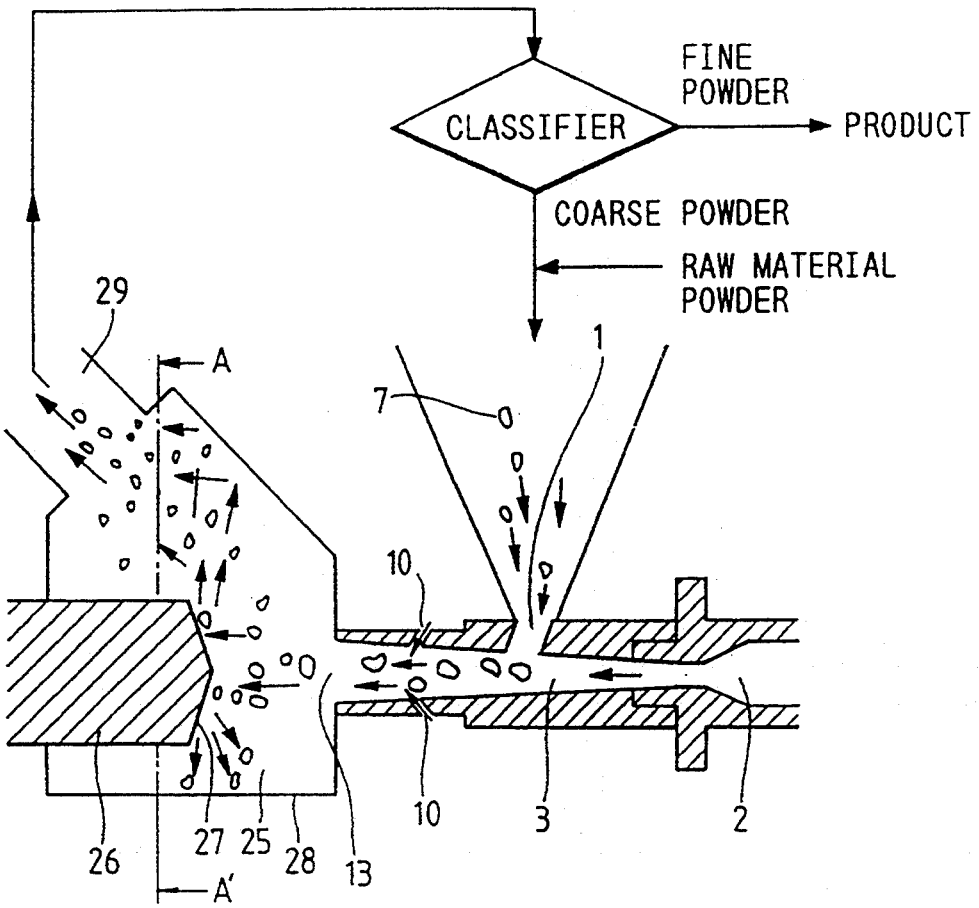

FIG. 9 a schematic cross-sectional view of a collision-type, gas current pulverizer according to the present invention, as used in a process for pulverization based on a combination of the present pulverizer and a classifying separator shown in the form of a diagram.

Figure 10:
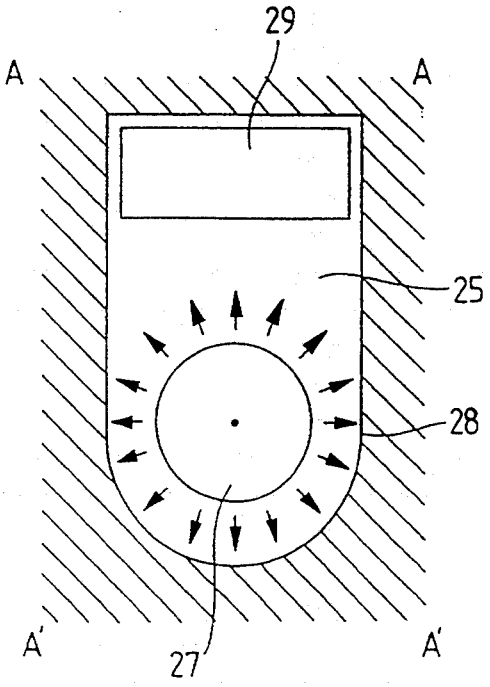

FIG. 10 is a view showing the pulverization chamber along the line A–A' of FIG. 9.

FIG. 9 is a view showing the essential part of the acceleration pipe.

Figure 11:
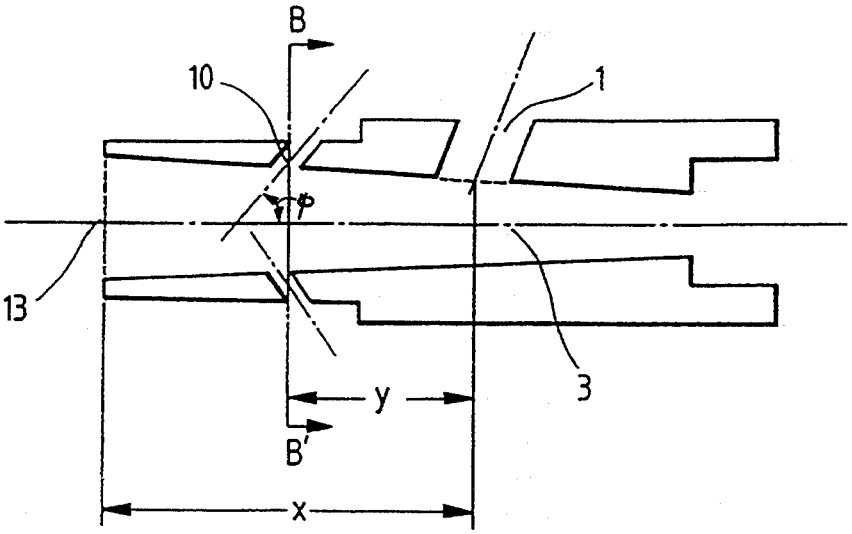
Figure 12:
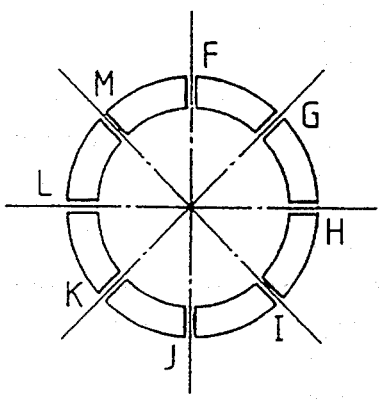

FIG. 12 is a view showing the arrangement of secondary air inlets along the line B–B' of FIG. 11.

Figure 13:
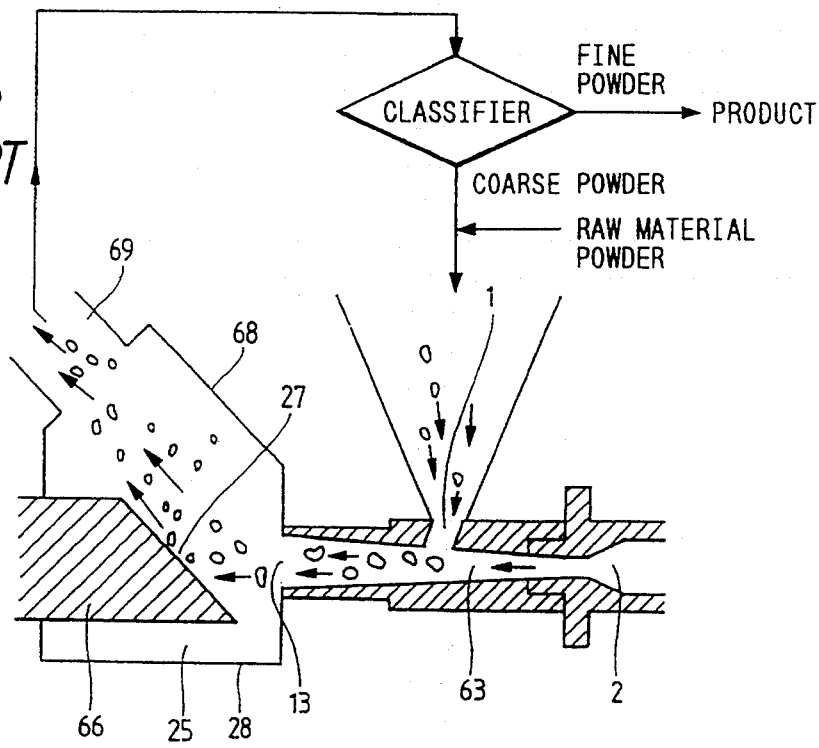
FIG. 13 PRIOR ART

FIG. 13 is a schematic cross-sectional view of another collision-type, gas current pulverizer according to the prior art, as used in a process for pulverization shown in the form of a flow diagram.

Figure 14:
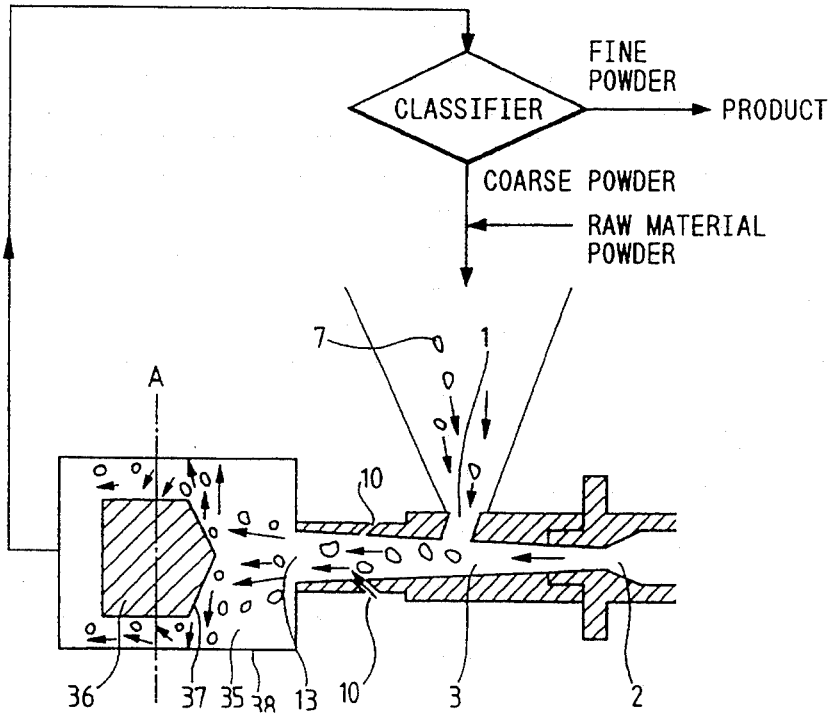

FIG. 14 is a schematic cross-sectional view of another collision-type, gas current pulverizer according to the present invention, as used in a process for pulverization based on a combination of the pulverizer and a classifying separator shown in the form of a flow diagram.

Figure 15A:
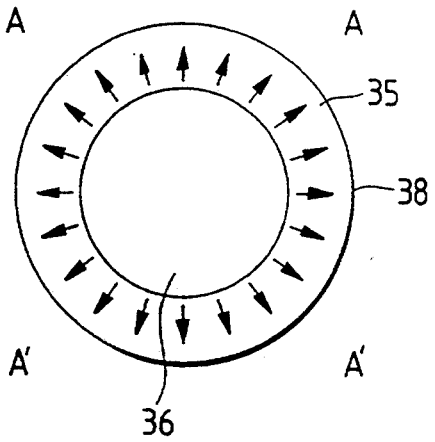
Figure 15B:
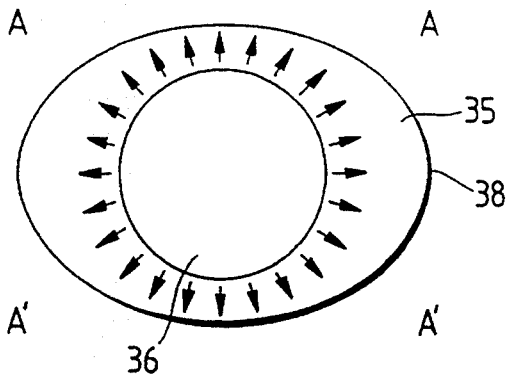

FIGS. 15A and 15B are views showing the inside of the pulverization chamber along the line A–A' of FIG. 14.

Figure 16:
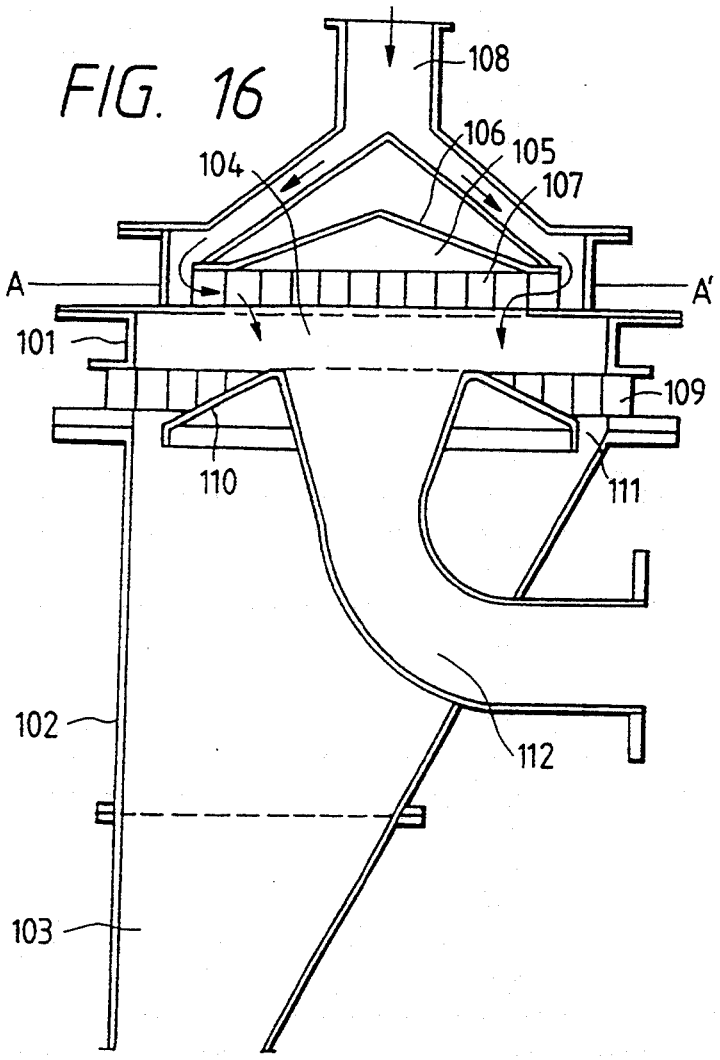

FIG. 16 is a schematic cross-sectional view of one embodiment of a gas current, classifying separator for use in a pneumatic pulverizing system according to the present invention.

Figure 17:
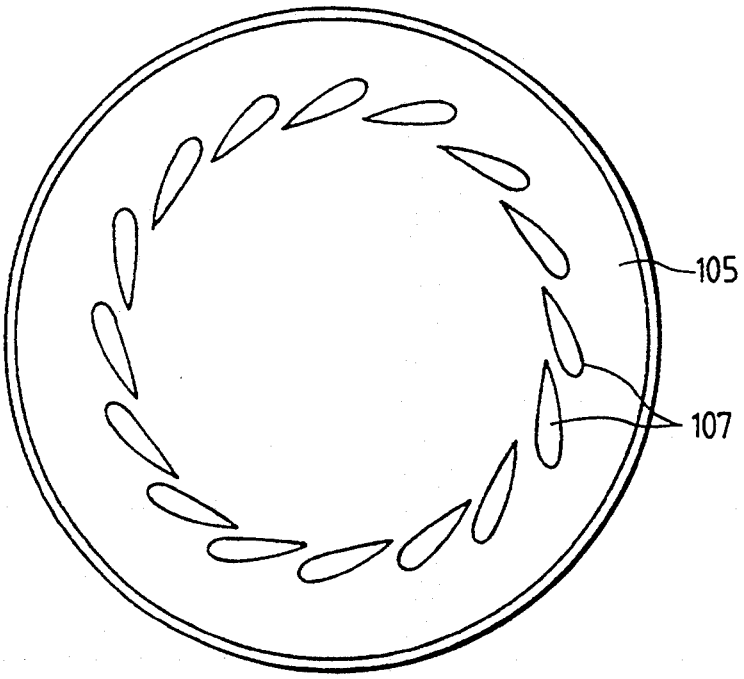

FIG. 17 is a cross-sectional view along the line A–A' of FIG. 16.

Figure 18:
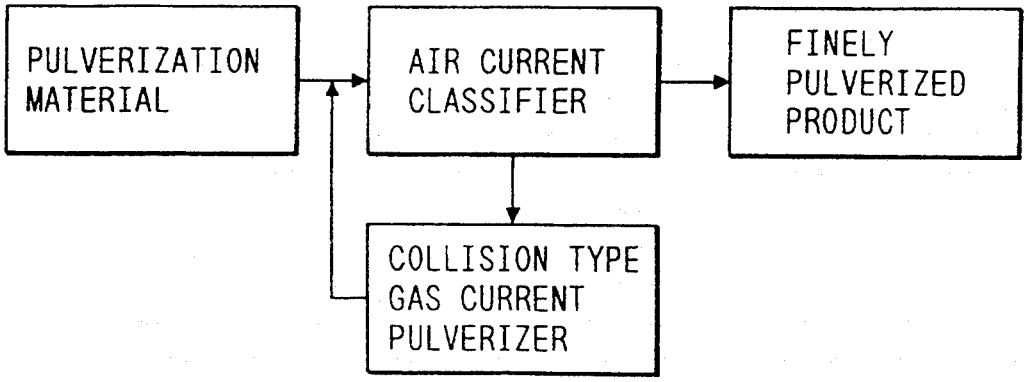

FIG. 18 is a block flow diagram showing an arrangement of a pulverizing means and a classifying means for use in the pneumatic pulverizing system according to the present invention.

Figure 19:
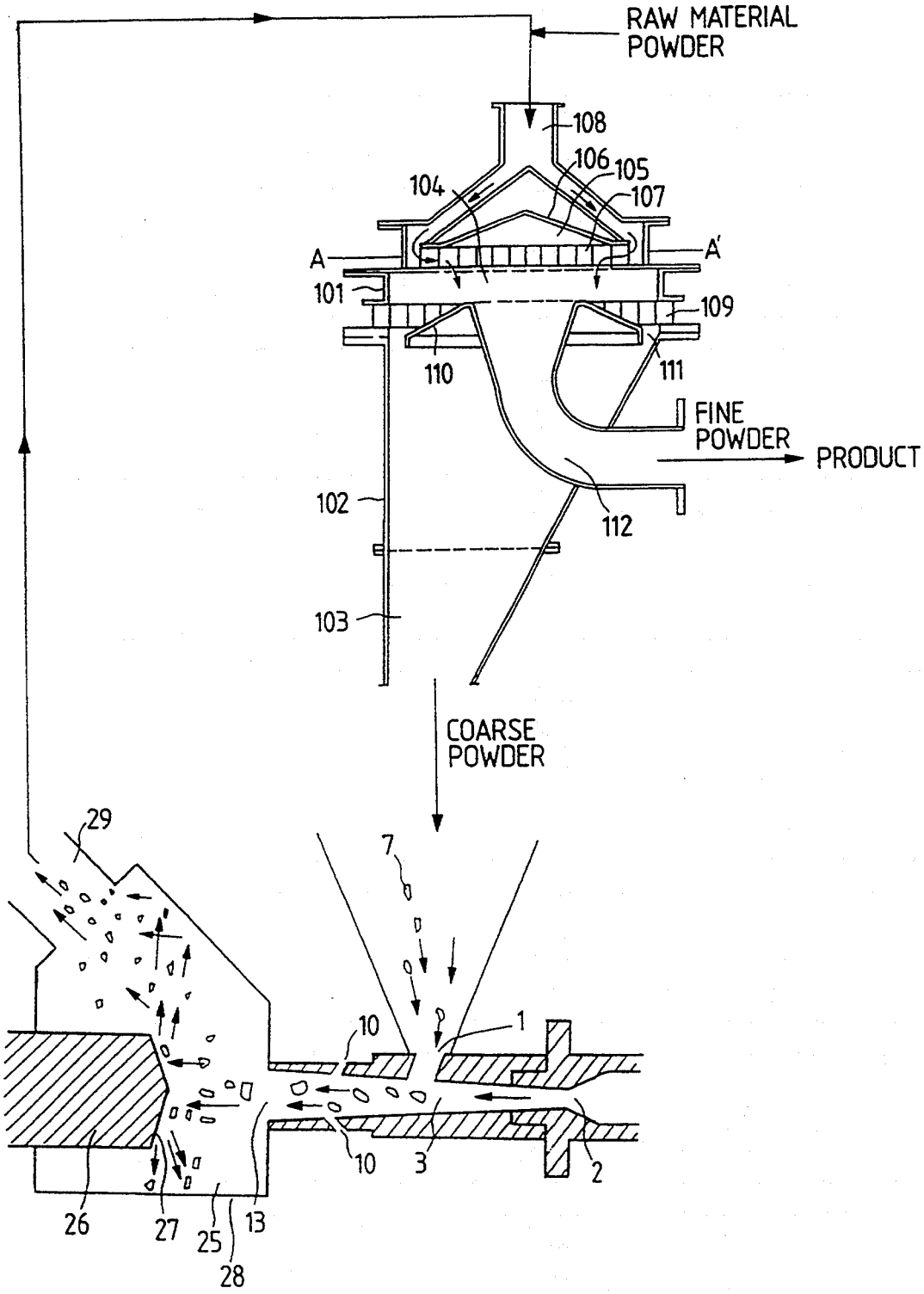

FIG. 19 is a schematic cross-sectional view showing one embodiment of a pneumatic pulverizing system according to the present invention.

Figure 20:
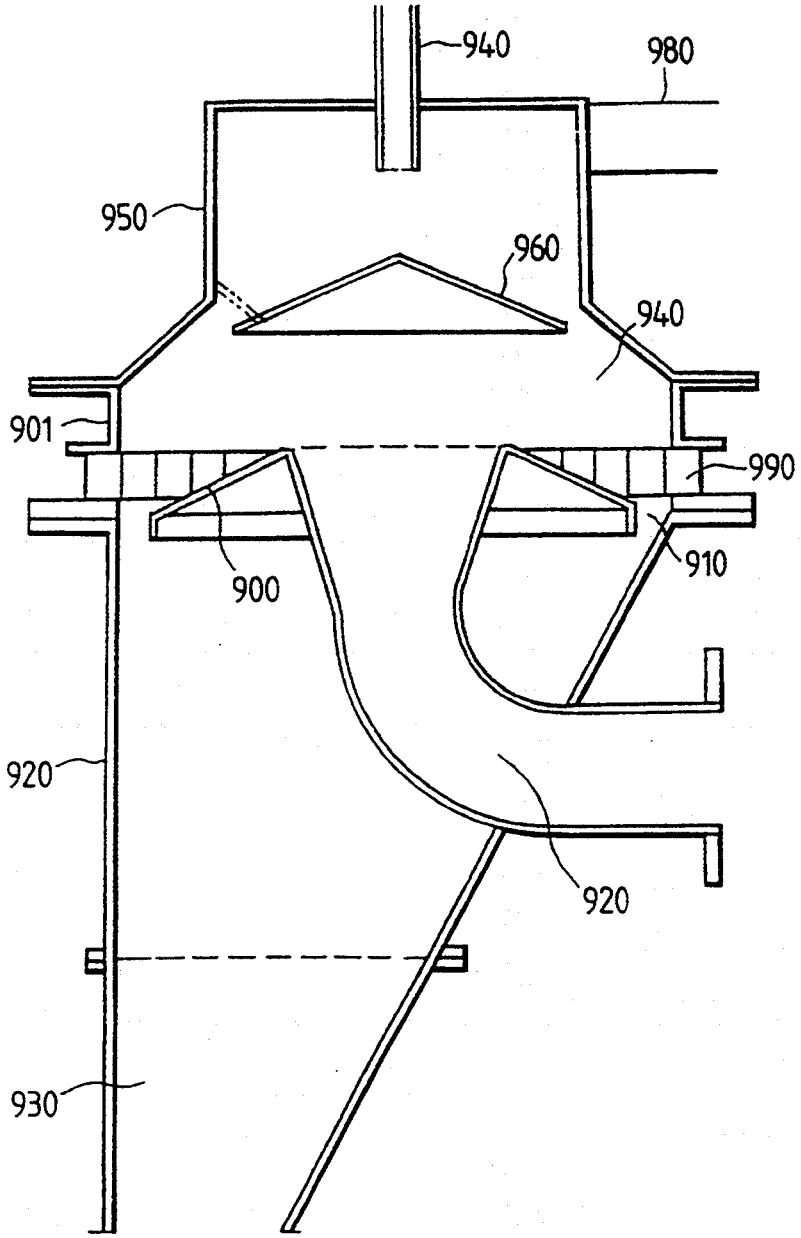

FIG. 20 is a schematic cross-sectional view showing an ordinary gas current, classifying separator.

DETAILED DESCRIPTION OF THE PREFERRED EMBODIMENTS

The present invention provides a collision-type, gas current pulverizer which comprises an acceleration pipe for transporting powders under acceleration by a high pressure gas, a pulverization chamber, and a collision member for pulverizing the powders ejected from the acceleration pipe by a force of collision, the collision member being provided against the outlet of the acceleration pipe, characterized in that a raw material powder supply inlet is provided at the acceleration pipe and a secondary air inlet is provided between the raw material powder supply inlet and the outlet of the acceleration pipe.

The present invention also provides a process for pulverizing powders, which comprises transporting powders under acceleration by a high pressure gas through an acceleration pipe, and discharging the powders into a pulverization chamber at the outlet of the acceleration pipe, thereby allowing the powders to collide with the collision member counterposed to the outlet of the acceleration pipe, characterized by introducing a secondary air into the acceleration pipe.

The present collision-type, gas current pulverizer can efficiently pulverize powders as a pulverizable raw material to sizes on the order of a few μm by utilizing a high speed gas current.

Particularly, the present collision-type, gas current pulverizer can efficiently pulverize powders of thermoplastic resin or powders composed mainly of thermoplastic resin to sizes in the order of a few μm by utilizing a high speed gas current.

The present invention will be explained in detail, referring to the accompanying drawings.

Figure 1:
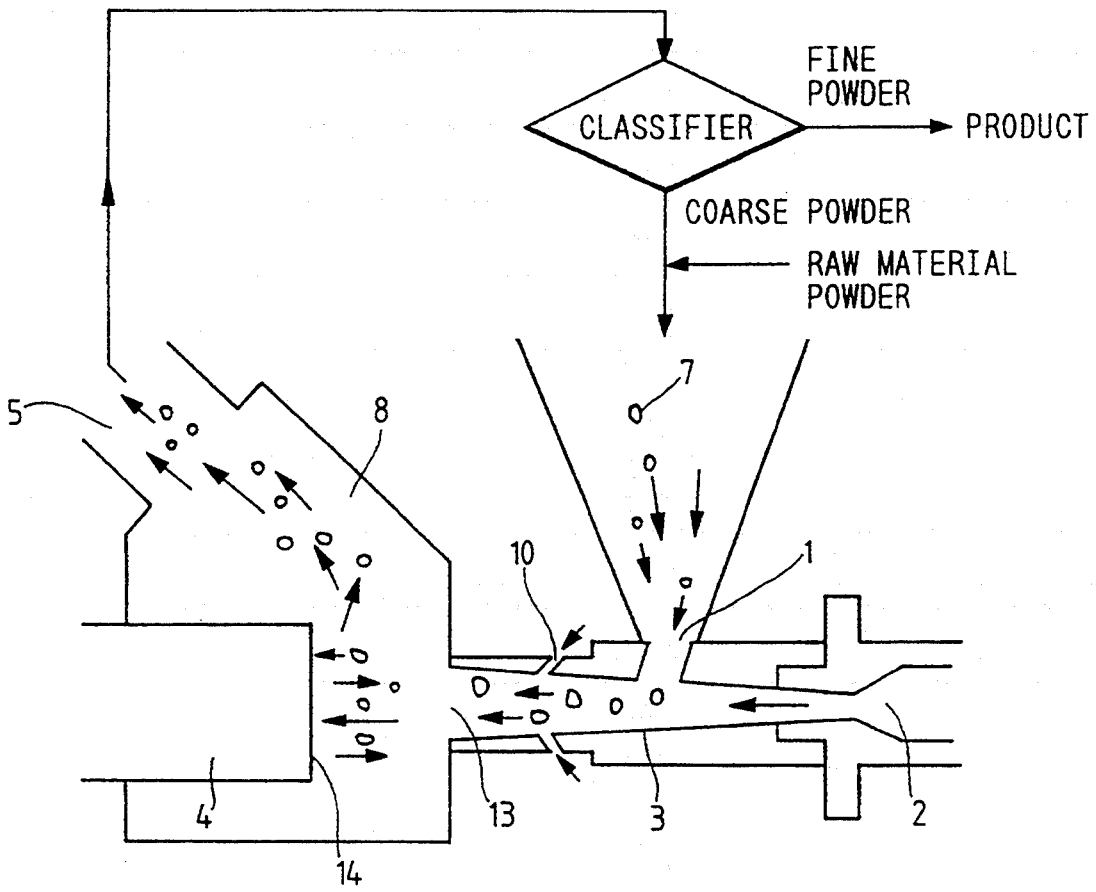
FIG. 1 is a schematic cross-sectional view of a collision-type, gas current pulverizer according to the present invention as used in a process for pulverization based on a combination of a pulverization step using the present pulverizer and a classification step using a classifying separator shown in the form of a flow diagram.

FIG. 1 is a schematic cross-sectional view of a collision-type, gas current pulverizer according to the present invention, as used in a process for pulverization based on a combination of a pulverizing step using the pulverizer and a classifying step using a classifier shown in the form of a flow diagram.

Raw material powders 7 to be pulverized is supplied into an acceleration pipe 3 at a raw material powder supply inlet 1 provided at the acceleration pipe 3. A compressed gas such as a compressed air is introduced into the acceleration pipe 3 from a compressed gas supply nozzle 2 of a level type, and the raw material powder 7 supplied into the acceleration pipe 3 is instantaneously accelerated by the introduced compressed gas to have a high speed. The raw material powders 7 ejected from an outlet 13 of the acceleration pipe into a pulverization chamber 8 at a high speed collide with the collision surface 14 of a collision member 4 and are pulverized thereby.

In the present invention, a passage having a secondary air inlet 10 is provided between the raw material powder supply inlet 1 and the outlet 13 of the acceleration pipe 3 in FIG. 1 to efficiently disperse the powders in the acceleration pipe by introducing the secondary air into the acceleration pipe. That is, the powders can be uniformly ejected at the outlet 13 of the acceleration pipe 3, thereby allowing the powders to efficiently collide with the collision surface 14 of the collision member counterposed to the outlet 13 of the acceleration pipe and improving the pulverization efficiency much more than that of the prior art. The introduced secondary air disassembles aggregates of powders moving at a high speed through the acceleration pipe 3, thereby contributing to dispersion of the powders through the acceleration pipe 3.

Figure 2:
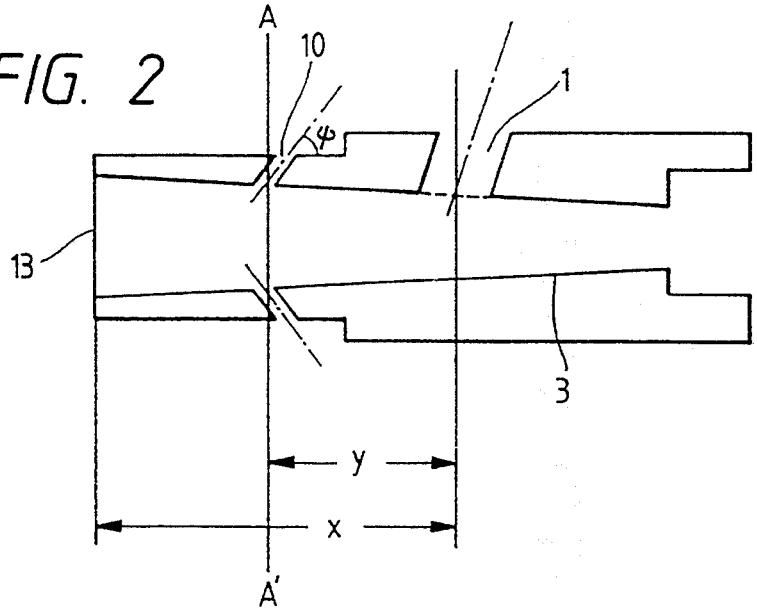
FIG. 2 is a cross-sectional view of the acceleration pipe used in the present collision-type, gas current pulverizer.

FIG. 2 shows an enlarged cross-sectional view of the acceleration pipe 3. As a result of extensive studies on how to introduce the secondary air into the acceleration pipe 3, the present inventors have drawn the following conclusion.

Better results can be obtained at such a position of introducing the secondary air that x and y can satisfy the following correlation:

$$0.2 \leqq y/x \leqq 0.9,$$

more preferably $$0.3 \leqq y/x \leqq 0.8,$$

where x is a distance between the raw material powder supply inlet 1 and the outlet 13 of the acceleration pipe and y is a distance between the raw material powder supply inlet 1 and the secondary air inlet 10 in FIG. 2.

Better pulverization can be obtained at such an angle of the passage having the secondary air inlet that $\psi$ satisfies the following condition:

$$10° \leqq \psi \leqq 80°,$$

more preferably $$20° \leqq \psi \leqq 80°$$

where $\psi$ is an angle of the passage having the secondary air inlet to the axial direction of the acceleration pipe 3 in FIG. 2.

Better results can be obtained when the pulverization is carried out at such a flow rate of the introduced secondary air that satisfies the following condition:

$$0.001 \leqq b/a \leqq 0.5,$$

more preferably $$001 \leqq b/a \leqq 0.4$$

wherein "a" is a flow rate of carrier gas current of high pressure gas introduced from the compressed gas supply nozzle 2 in $Nm^3$/min. and "b" is a total flow rate of the secondary air introduced at the secondary air inlet in $Nm^3$/min.

In a collision-type, gas current pulverizer for carrying out pulverization by adding raw material powders to a carrier gas stream of high pressure gas introduced from a compressed gas supply nozzle and ejecting the gas stream at the outlet of an acceleration pipe, thereby allowing the powders to collide with a collision plate counterposed to the outlet of the acceleration pipe, the present invention is based on such a concept that the dispersion state of powders in the acceleration pipe influences the pulverization efficiency. The present inventors have found that the raw material powders are supplied into the acceleration pipe in an aggregate state, resulting in an insufficient dispersion of the powders in the acceleration pipe. Thus, the powder concentration is not uniform when the powders are ejected at the outlet of the acceleration pipe and the collision surface of the collision plate is not effectively utilized, resulting in a decrease in the pulverization efficiency. This phenomenon is much pronounced with increasing capacity for treating the powders.

The present invention has been accomplished on the basis of such a concept that the secondary air is introduced into the acceleration pipe so as to disperse the raw material powder without disturbing the carrier gas stream of high pressure gas, thereby solving the problems.

The secondary air for use in the present invention may be a compressed, high pressure gas or an atmospheric pressure gas. It is very preferable to provide a damper such as a value at the secondary air inlet 10 to control the flow rate of the secondary air to be introduced. The position and the number of the passage for the secondary air in the circumferential direction of the acceleration pipe 3 and can be appropriately determined in view of the pulverizable raw material, desired size of powders, etc.

Figure 3:
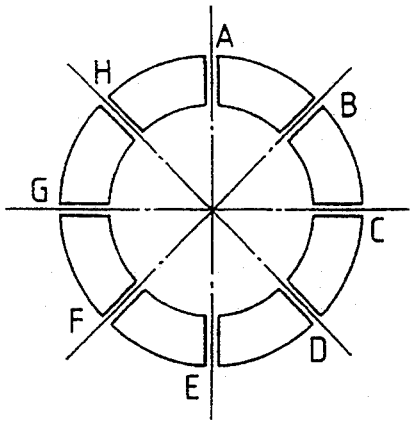
FIG. 3 is a cross-sectional view of the acceleration pipe along the line A–A' of FIG. 2.

FIG. 3 is a cross-sectional view of an acceleration pipe provided with passages each having a secondary air inlet 10 at 8 positions in the circumferential direction of the acceleration pipe along the line A–A' of FIG. 2, where flow rate proportions of the secondary air to be introduced at the the eight positions may be appropriately set. The cross-section of the acceleration pipe is not limited to the circular form.

The inner diameter of the outlet 13 of the acceleration pipe is usually 10 to 100 mm, and is preferably smaller than the diameter of the collision member 4.

The distance between the outlet 13 of the acceleration pipe and the tip end of the collision member 4 is preferably 0.3 to 3 times the diameter of the collision member 4. Below 0.3 times, overpulverization is liable to take place, whereas above 3 times the pulverization efficiency is liable to decrease.

The pulverization chamber of the present collision-type, gas current pulverizer is not limited to the box form shown in FIG. 1. The collision surface of the collision member 4 is not limited to the surface perpendicular to the axial direction of the acceleration pipe as shown in FIG. 1, and is preferably a surface having such a shape as to efficiently rebound the powders ejected at the outlet of the acceleration pipe, thereby allowing the rebounded powders to undergo a second collision on the wall of the pulverization chamber.

As explained above, the raw material powders are uniformly dispersed in the acceleration pipe in the present apparatus and process and thus can efficiently collide with the surface of the collision plate, thereby improving the powder pulverization efficiency. As compared with the prior art pulverizers, the treating capacity can be increased and the particle sizes of the pulverized product obtained in the increases treating capacity can be significantly reduced.

In the prior art pulverizers, the powders collide with the collision plate in an aggregate state, and thus particularly in case of powders composed mainly of thermoplastic resin, a fusion product is liable to be formed. In the present invention, on the other hand, the-powders collide with the collision plate in a uniformly dispersed state, and thus the fusion product is less formed.

Furthermore, in the prior art pulverizers, the powders are in an aggregate state and thus overpulverization is liable to take place, resulting in such a problem that the particle distribution of the thus obtained pulverized product is coarse, whereas in the present invention the overpulverization can be prevented and thus a pulverized product with a sharp particle size distribution can be obtained.

In the present invention, the secondary air can be efficiently introduced into the acceleration pipe, thereby increasing the pneumatic suction capacity at the raw material powder supply inlet 1. That is, the raw material powder, transporting capacity through the acceleration pipe 3 can be increased, thereby increasing the powder-treating capacity over the prior art capacity. In the present apparatus and process, the smaller the particle sizes of the powders, the more remarkable the pulverization-effect.

Figure 5:
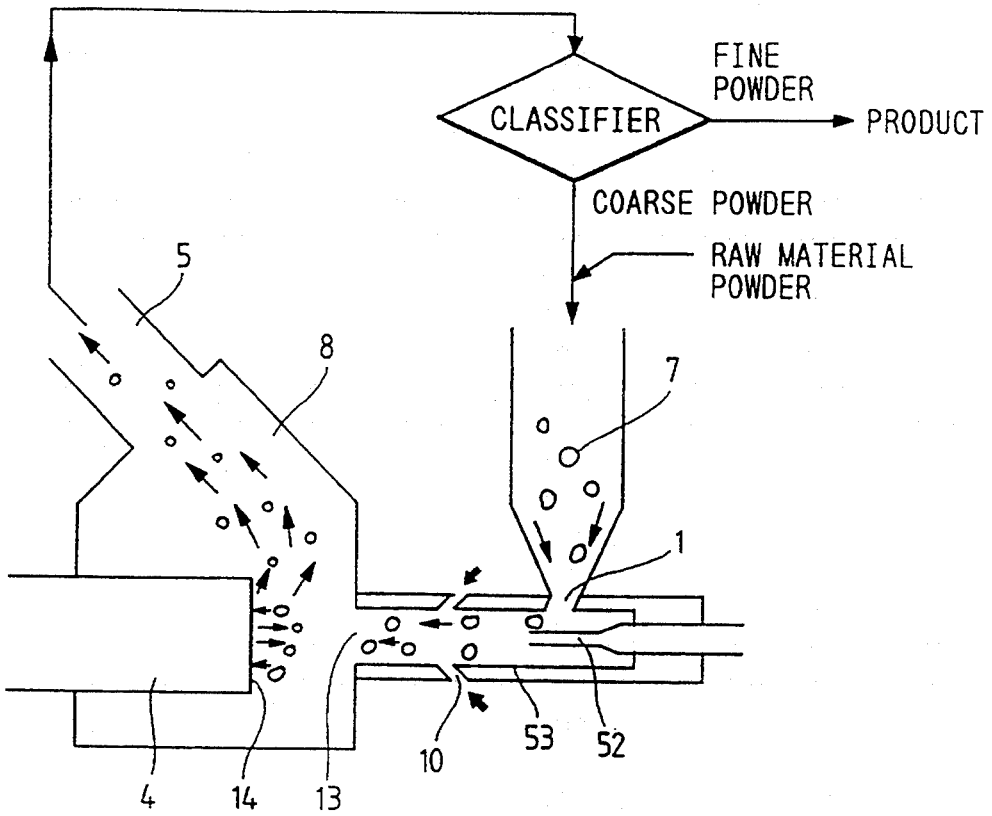
FIGS. 5 and 7 are schematic cross-sectional views of other collision-type, gas current pulverizers according to the present invention as used in a process for pulverization based on a combination of a pulverization step using the present pulverizers and a classification step using a classifying separator shown in the form of flow diagrams, respectively.
Figure 6:
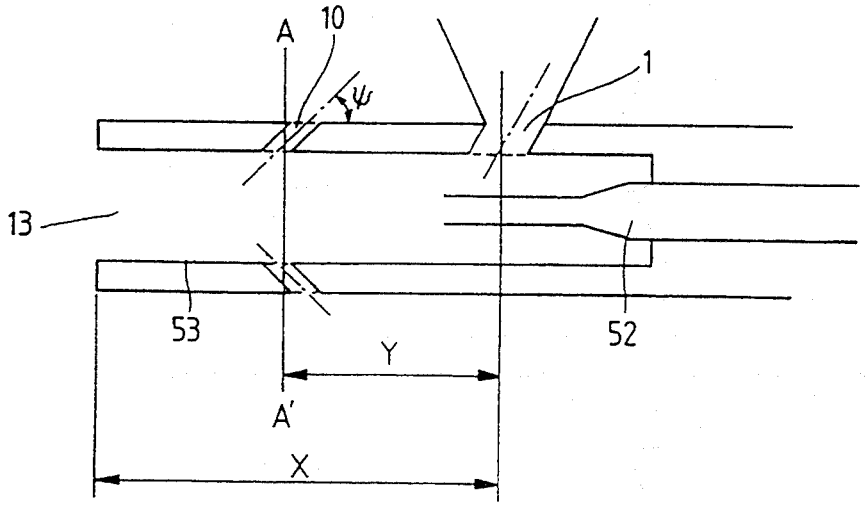
FIG. 6 is a cross-sectional view of a raw material powder supply pipe of the present collision-type, gas current pulverizer.
Figure 7:
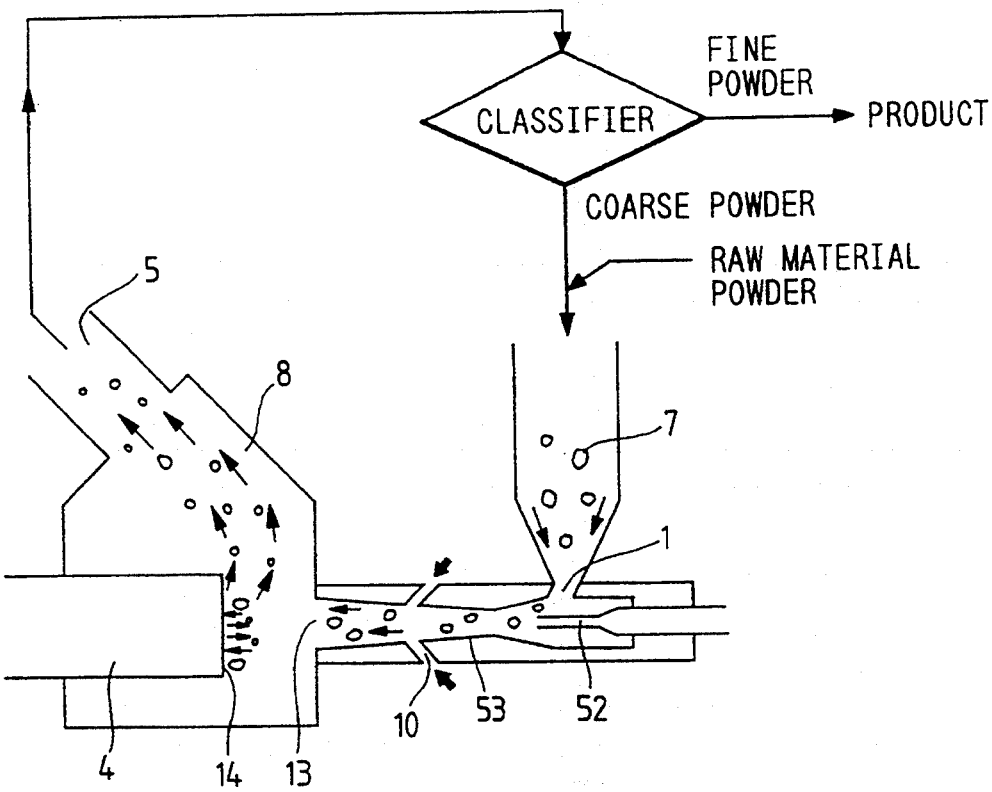

FIGS. 5 to 7 are schematic cross-sectional views of other embodiments of the present collision-type, gas current pulverizer.

In the present collision-type, gas current pulverizer shown in FIG. 5, an ejector type pipe is used as the compressed gas supply nozzle 52 and thus suction of pulverizable powders 7 from the raw material powder supply inlet 1 is improved thereby. That is, the embodiment shown in FIG. 5 is suitable for treating highly aggregating powders or powders of much smaller particle sizes.

FIG. 6 is an enlarged cross-sectional view of an acceleration pipe 53 and a compressed gas supply nozzle 52.

In the present collision-type, gas current pulverizer shown in FIG. 9, the collision surface 27 has a conical shape having an apex angle of 110° to less than 180°preferably around 160° (120°–170°), and thus the pulverized product can be dispersed substantially in the entire circumferential direction and allowed to undergo a secondary collision on the wall 28 of the pulverization chamber and can be further pulverized thereby.

FIG. 10 is a schematic cross-sectional view of the collision-type, gas current pulverizer along the line A–A′ of FIG. 9, schematically showing a dispersion state of the pulverized product after the collision on the collision surface 27. As is shown in FIG. 10, the secondary collision of the pulverized product on the wall 28 of the pulverization chamber is effectively utilized in the present collision-type, gas current pulverizer. Furthermore, as is shown in FIG. 9, the pulverized product is efficiently dispersed in the radial direction of the collision member on the collision surface 27, and thus the wall 28 of the pulverization chamber is extensively utilized for the secondary collision. Thus, the concentration of pulverized product (or further pulverizable powders) is not increased near the collision surface 27 and thus the powder-treating capacity can be increased, thereby efficiently suppressing the fusion of the pulverized product (or further pulverizable powders) on the collision surface 27.

The pulverizable powders introduced into the pulverization chamber 25 are pulverized by the primary collision on the collision surface 27, then further pulverized by the secondary collision on the wall 28 of the pulverization chamber and still further pulverized by the tertiary (and quaternary) collision on the wall 28 of the pulverization chamber and the side surfaces of the collision member 26 until the pulverized product is transported to the discharge outlet 29. The pulverized product discharged at the discharge outlet is classified into fine powders and coarse powders by a classifying separator such as a stationary wall-type pneumatic classifying separator. The classified fine powders are withdrawn as a pulverization product, whereas the classified coarse powders as charged into the raw material powder supply inlet 1 together with fresh pulverizable powders.

FIG. 14 is a schematic cross-sectional view of other collision-type, gas current pulverizer according to the present invention.

In the pulverizer of FIG. 14, a process for pulverization is carried out by transporting pulverizable powders under acceleration by a high pressure gas through an acceleration pipe, ejecting the pulverizable powders into a pulverization chamber at the outlet of the acceleration pipe, and allowing the pulverizable powders to collide with a collision member counterposed to the outlet of the acceleration pipe, thereby pulverizing the pulverizable powders to finer powders, where the process is characterized by introducing a secondary air into the acceleration pipe at a location between the pulverizable powder supply inlet and the outlet of the acceleration pipe, allowing the pulverizable powders to collide with a collision member having a conical shape, the tip end of whose collision surface has an apex angle of 110° to less than 180° preferably 120° to 160°, thereby pulverizing the pulverizable powders, and allowing the pulverized powders resulting from the collision to undergo a secondary collision on the wall of the pulverization chamber having a cylindrical shape of circular crosssection on elliptical cross-section, thereby conducting further pulverization.

In the collision-type, gas current pulverizer of FIG. 14, the collision surface 37 has a conical shape at an apex angle of 110° to less than 180°, preferably around 160° (120° to 170°), and thus the resulting pulverized product is dispersed substantially in the entire circumferential direction to undergo a secondary collision on the wall 38 of the pulverization chamber, thereby undergoing further pulverization.

FIGS. 15A and 15B schematically show cross-sections along the line A–A′ of the present collision-type, gas current pulverizer shown in FIG. 14, where FIG. **15*a* shows the case that the pulverization chamber is in a cylindrical shape of circular cross-section and FIG. 15*b* shows the case that the pulverization chamber is in a cylindrical shape of elliptical cross-section, and the dispersion state of the pulverized product resulting from the collision on the collision surface 37 is schematically shown. As is shown in FIGS. 15A and 15B, the secondary collision of the pulverized product on the wall 38 of the pulverization chamber is effectively utilized in the present collision-type, gas current pulverizer. As shown in FIG. 14, the pulverized product is efficiently dispersed in the radial direction of the collision member on the collision surface 37, and thus the wall 38 of the pulverization chamber is extensively utilized for the secondary collision. Thus, the concentration of pulverized product (or further pulverizable powders) is not increased near the collision surface 37 and thus the powder-treating capacity can be increased, thereby efficiently suppressing the fusion of the pulverized product (or further pulverizable powders) on the collision surface 37**.

Particularly in case of the pulverizer shown in FIG. 14, the pulverization chamber 35 is in a cylindrical shape of circular cross-section or elliptical cross-section, and thus the secondary collision can be more effectively carried out, and sometimes, the resulting pulverized product is further pulverized by a tertiary collision and a quaternary collision or further collisions on the wall 38 of the pulverization chamber and the side surfaces of the collision member 36 until the resulting pulverized product is transported to the discharge outlet. The positional relationship between the collision member 36 and the wall 38 of the pulverization chamber is not limited to those shown in FIGS. 15*a* and 15*b*.

The shape of the collision member is a conical shape, the tip end of whose collision surface is at an apex angle of 110° to less than 180°, preferably 120° to 170°, and its shape and the degree of the apex angle can be appropriately selected in view of the properties of pulverizable powders, desired particle size of pulverized product, etc.

The inner diameter of the acceleration tube outlet 13 is usually 10 to 100 mm, and preferably is smaller than the diameter of the collision member 36.

FIG. 18 is a block flow diagram showing one embodiment of the arrangement of a pulverizing means and a classifying means.

FIGS. 16 and 17 are schematic views of one embodiment of a pneumatic classifying separator used in the present pulverization system, where a toner can be efficiently produced by combination of the pneumatic classifying separator with the collision type, gas current pulverizer of FIG. 9.

In FIG. 16, numeral 101 shows a cylindrical main casing, and numeral 102 shows a lower casing, to which a hopper 103 for discharging coarse powders is connected. At the inside of the main casing 101, a classifying chamber 104 is formed. The overhead of the classifying chamber 104 is closed by an annular guide chamber 105 and an upper conical (bevel) cover 106 with an elevated height towards the center, each provided at the top of the main casing 101.

A plurality of louvers 107 arranged in the circumferential direction are provided on a partition wall between the classifying chamber 104 and the guide chamber 105, thereby allowing the powders and the air introduced into the guide chamber 105 to flow into the classifying chamber 104 through the clearances between the individual louvers 107, thereby making the powders and the air whirl in the classifying chamber.

A plurality of classifying louvers 109 arranged in the circumferential direction are provided at the bottom of the main casing 101 and a classifying air causing a whirling stream is introduced into the classifying chamber 104 from the outside through the clearances between the individual classifying louvers 109.

At the bottom of the classifying chamber 104, a classifying plate 110 of a conical shape (bevel shape) with an elevated height towards the center is provided to form a coarse powder discharge outlet 111 around the outer circumference of the classifying plate 110. The center part of the classifying plate 110 is communication with a fine powder discharge chute 112, which is bent into an L-shape towards the lower end. The bent lower end is protruded through the side wall of the lower casing 102 and located at the outside of the side wall.

The chute is connected to a suction fan through a fine powder recovery means such as a cyclone or a dust collector, and a suction force is developed in the classifying chamber 104 by actuating the suction fan, thereby introducing the suction air into the classifying chamber 104 through the clearances between the individual classifying louvers 109 to generate a whirling air stream necessary for the classification.

The pneumatic classifying separator has the above-mentioned structure.

An air containing powder (which comprises the pulverized product and air used for the pulverization in the collision-type, gas current classifier and freshly supplied pulverizable raw material powders) is supplied into the guide chamber 105 through the supply cylinder 108 and then introduced into the classifying chamber 104 from the guide chamber 105 through the clearances between the individual louvers 107 while being whirled and dispersed at a uniform concentration.

The powders introduced into the classifying chamber 104 while being whirled are entrained into the suction air stream also introduced into the classifying chamber 104 through the clearances between the individual classifying louvers 109 provided at the bottom of the classifying chamber 104 by the suction fan connected to the fine powder discharge chute 112, thereby intensifying the whirling. The powders are centrifugally classified into coarse powders and fine powders by centrifugal forces acting on the individual powder particles. The coarse powders whirling around the outer peripheral region in the classifying chamber 104 are discharged at the coarse powder discharge outlet 111 through the lower hopper 103 and supplied again into the collision-type, gas current pulverizer.

The fine powder moving towards the center part along the upper inclined surface of the classifying plate 110 are discharged through the fine powder discharge chute 112 to the fine powder recovery means as a fine powder product.

The air introduced together with the powders into the classifying chamber 104 is all in a whirling stream, and thus the center-directed speed of the whirling powder particles in the classifying chamber 104 is relatively low, as compared with the centrifugal force, and thus classifying separation of powder particles having smaller particle sizes is carried out in the classifying chamber 104, thereby discharging fine powders having very small particle sizes into the fine powder discharge chute 112. Still furthermore, the powders are introduced into the classifying chamber substantially at a uniform concentration, and thus the fine powder product of sharp particle size distribution can be obtained.

That is, fine powders of sharp particle size distribution can be obtained as a fine powder product without producing ultra-fine powders, as already mentioned before, and thus a toner with good properties can be obtained as a final product.

when the pneumatic classifying separator as shown in FIG. 16 is used in combination with the collision-type, gas current pulverizer as shown in FIG. 1, FIG. 5, FIG. 7, FIG. 9 or FIG. 14, a synergistic effect can be obtained by the combination, and well classified, fine powder particles can be obtained as a final product. That is, a toner with good properties can be efficiently obtained. In the present invention, the smaller the particle size, the more remarkable the effect.

The present invention will be further explained below, referring to the case of using the pulverized product as a toner for an electrophotographic developing agent or as color resin particles for the toner.

A toner is composed of powders having an average particle size of 5 to 20 μm. A toner may be composed only of color resin particles for the toner or may be composed of color resin particles for the toner and an additive such as silica. The color resin particles for the toner is composed of a binder resin and a coloring agent or magnetic powder, and if required, contains a charge-controlling and/or an additive such as an off-set inhibitor.

The binder resin includes, for example, styrene-based resin, epoxy resin and polyester-based resin with a glass transition point (Tg) of 50° to 120° C. The coloring agent includes various dyes and pigments such as carbon black, nigrosine-based dyes and phthalo-cyanine-based pigments. The magnetic powders include powders of metals or metal oxides which can be magnetized by application of a magnetic field, such as iron, magnetite, and ferrite.

A mixture of the binder resin and the coloring agent (or magnetic powders) is kneaded under melting, and the molten mixture is cooled. The cooled mixture is subjected to coarse or medium pulverization to obtain raw material powders having an average particle size of 30 to 1,000 μm.

PREFERRED EMBODIMENTS OF THE INVENTION

The present invention will be described in detail below, referring to Examples.

EXAMPLE 1

A mixture (toner raw materials) composed of the following components:

| | |
|---|---|
| Styrene-acrylic resin | 100 parts by weight |
| Magnetic powders (0.3 μm) | 60 parts by weight |
| Negative charge-controlling agent | 2 parts by weight |
| Low molecular weight polypropylene resin | 4 parts by weight |

were kneaded with heating and then cooled to solidification. Then, the solidified mixture was coarsely pulverized to particles having particle sizes of 100 to 1,000 μm by a hammer mill. Then, the thus obtained pulverizable raw material powder was pulverized in the same collision-type, gas current pulverizer by the same process flow scheme as shown in FIGS. 1. A fixed wall-type, pneumatic classifying separator was used as a classifying means for classifying the resulting pulverized product into fine powders and coarse powders.

The acceleration pipe of the collision-type, gas current pulverizer had the following dimensions in FIG. 2:

$$x = 80\text{ mm}, y = 45\text{ mm}\left(\frac{y}{x} \simeq 0.56\right)\text{and } \psi = 60^\circ$$

The acceleration pipe had secondary air inlets at 8 positions in the circumferential direction as shown in FIG. 3.

The compressed air was introduced into the acceleration pipe from the compressed gas supply nozzle at a flow rate "a" of 6.4 $Nm^3$/min. (6.0 kg/$cm^2$), and the compressed secondary air was also introduced into the acceleration pipe at 4 positions A, C, E and G in FIG. 3, (the position B, D, F and H were closed) each at a flow rate "b" of 0.1 $Nm^3$/min. (6.0 kg/cm²).

$$\frac{\text{Flow rate of secondary air "}b\text{"}}{\text{Flow rate of high pressure air "}a\text{"}} = \frac{0.1 \times 4}{6.4} \simeq 0.06$$

The pulverizable raw material powders were ejected into the pulverization chamber 8 through the acceleration pipe 3 from the raw material powder supply inlet 1 at a rate of 15 kg/hr. and allowed to collide with the collision surface of the collision plate 14, thereby pulverizing the pulverizable raw material powders. The resulting pulverized product was transported to the pneumatic classifying separator to withdraw fine powders as the classified powders, whereas the classified coarse powders were returned to the acceleration pipe 3 together with the pulverizable raw material powders through the raw material supply inlet 1.

As the fine powders, pulverized powders having a weight average particle size of 6.0 μm [measured by coulter counter (aperture: 100 μm)] were recovered at a rate of 15 kg/hr.

EXAMPLE 2

The same pulverizable raw material powders as used in Example 1 were pulverized in the same collision-type, gas current pulverizer by the same process flow scheme as shown in FIG. 1.

A fixed wall-type, pneumatic classifying separator was used as a classifying means for classifying the pulverized powders into fine powder and coarse powders.

The acceleration pipe 3 of the collision-type, gas current pulverizer had the following dimensions in FIG. 2:

$$x = 80\text{ mm}, y = 45\text{ mm}\left(\frac{x}{y} \simeq 0.56\right)\text{and } \psi = 45^\circ$$

The acceleration pipe had secondary air inlets at 8 positions in the circumferential direction in FIG. 3.

The compressed air was introduced into the acceleration pipe from the compressed air supply nozzle at a flow rate "a" of 6.4 $Nm^3$/min. (6.0 kg/$cm^2$) and the compressed secondary air was also introduced into the acceleration pipe at 4 positions A, C, E and G in FIG. 3 (B, D, F and H were closed) each at a flow rate "b" of 0.1 $Nm^3$/hr (6.0 kg/$cm^2$).

$$\frac{\text{Flow rate of secondary air "}b\text{"}}{\text{Flow rate of high pressure air "}a\text{"}} = \frac{0.1 \times 4}{6.4} \simeq 0.06$$

The pulverizable raw materials powders were supplied from the raw material powder supply inlet 1 at a rate of 16 kg/hr. The resulting pulverized product was transported to the classifying separator, and the fine powders were withdrawn as the classified powders, whereas the coarse powders were returned to the acceleration pipe 3 together with the pulverizable raw material powders from the inlet 1.

The pulverized powders having a weight average particle size of 6.0 μm [measured by a coulter counter (aperture; 100 μm) was recovered at a rate of 16 kg/hr. as the fine powders.

EXAMPLE 3

The same pulverizable raw material powders as in Example 1 were pulverized in the same collision-type, gas current pulverizer by the same process scheme as shown in FIG. 1.

A fixed wall-type, pneumatic classifying separator was used as a classifying means for classifying the pulverized product into fine powders and coarse powders.

The acceleration pipe of the collision-type, gas current pulverizer had the following dimensions in FIG. 2:

$$x = 80 \text{ mm}, y = 45 \text{ mm} \left(\frac{x}{y} \simeq 0.56\right) \text{and } \psi = 45°$$

The acceleration pipe had secondary air inlets at 8 position in the circumferential direction in FIG. 3.

The compressed air was introduced from the compressed gas supply nozzle at a rate "a" of 6.4 $Nm^3$/min. (6.0 kg/$cm^2$) and the compressed secondary air was introduced from 6 positions A, B, C, E, H and G in FIG. 3 (the positions D and F were closed) each at a rate "b" of 0.1 $Nm^3$/min. (6.0 kg/$cm^2$).

$$\frac{\text{Flow rate of secondary air "}b\text{"}}{\text{Flow rate of high pressure air "}a\text{"}} = \frac{0.1 \times 6}{6.4} \simeq 0.09$$

The pulverizable raw material powders were supplied from the raw material powder inlet 1 at a rate of (19 kg/hr., and the resulting pulverized product was transported to the classifying separator to withdraw the fine powders as classified powders, whereas the coarse powders were returned to the acceleration pipe 3 together with the pulverizable raw material powders from the inlet 1.

The pulverized powders having a weight average particle size of 6.0 μm [measured by a coulter counter (aperture: 100 μm)] was recovered at a rate of 19 kg/hr. as the fine powders.

Comparative Example 1

Figure 4:
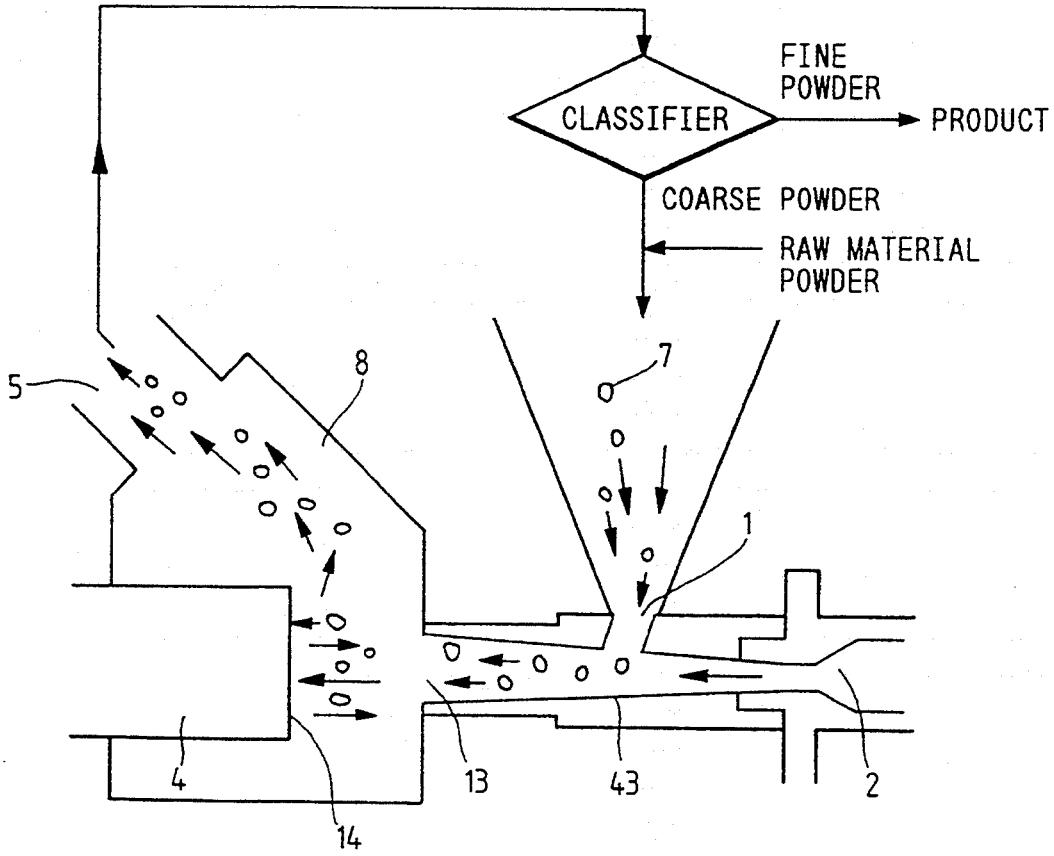
FIG. 4 PRIOR ART
FIG. 4 is a schematic cross-sectional view of a collision-type, gas current pulverizer according to the prior art, as used in a process for pulverization based on a combination of a pulverization step using the prior art pulverizer and a classification step using a classifying separator shown in the form of a flow diagram.

The same pulverizable raw material powders as used in Example 1 were pulverized in a conventional collision-type, gas current pulverizer without any secondary air inlet as shown in FIG. 4 and the pulverized product was classified in a fixed wall-type, pneumatic classifying separator as a classifying separator for classifying the pulverized product into fine powders and coarse powders.

The compressed air was introduced into the acceleration pipe 43 of the collision-type, gas current pulverizer from the compressed gas supply nozzle at a flow rate of 6.8 $Nm^3$/min. (6.0 kg/$cm^2$), and the pulverizable raw material powders were supplied from the raw material powder supply inlet at a rate of 12 kg/hr. The pulverized product was transported to the classifying separator to withdraw the fine powders as classified powders, whereas the coarse powders were returned to the acceleration pipe together with the pulverizable raw material powders from the inlet 1.

Pulverized powders having a weight average particle size of 6.0 μm [measured by a Coulter counter (aperture: 100 μm)] were recovered at a rate of 12 kg/hr. as fine powders.

EXAMPLE 4

The same pulverizable raw material powders as used in Example 1 were supplied from the raw material powder supply inlet 1 at a rate of 20 kg/hr. into a collision-type, gas current pulverizer with the same structure under the same conditions as in Example 1. The pulverized product was transported to the same classifying separator as used in Example 1 to withdraw the fine powders as the classified powders, whereas the coarse powders were returned into the acceleration pipe together with the pulverized raw material powders from the inlet 1.

Pulverized powders having a weight average particle size of 7.5 μm [measured by a coulter counter (aperture: 100 μm)] were recovered at a rate of 20 kg/hr. as fine powders.

EXAMPLE 5

The same pulverizable raw material powders as used in Example 1 were supplied from the raw material powder supply inlet 1 at a rate of 24 kg/hr. into a collision-type, Gas current pulverizer with the same structure under the same conditions as in Example 3. The pulverized product was transported to the same classifying separator as used in Example 1 to withdraw the fine powders as the classified powders, whereas the coarse powders were returned into the acceleration pipe together with the pulverized raw material powders from the inlet 1.

Pulverized powders having a weight average particle size of 7.5 μm [measured by a coulter counter (aperture: 100 μm)] were recovered at a rate of 24 kg/hr. as fine powders.

Comparative Example 2

The same pulverizable raw material powders as used in Example 1 were supplied from the raw material powder supply inlet 1 at a rate of 16.5 kg/hr. into a collision-type, Gas current pulverizer with the same structure under the same conditions as in Comparative Example 1.

The pulverized product was transported to the classifying separator to withdraw the fine powders as the classified powders, whereas the coarse powders were returned into the acceleration pipe 43 together with the pulverizable raw material powders from the inlet 1.

Pulverized powders having a weight average particle size of 7.5 μm [measured by a coulter counter (aperture: 100 μm)] were recovered at a rate of 16.5 kg/hr. as fine powders.

EXAMPLE 6

The same pulverizable raw material powders as used in Example 1 were supplied from the raw material powder supply inlet at a rate of 32 kg/hr. into a collision-type, gas current pulverizer with the same structure under the same conditions as in Example 1.

The pulverized product was transported to the classifying separator to withdraw the fine powders as the classified powders, whereas the coarse powders were returned into the acceleration pipe 3 together with the pulverizable raw material powders from the inlet 1.

Pulverized powders having a weight average particle size of 11.0 μm [measured by a coulter counter (aperture: 100 μm)] were recovered at a rate of 32 kg/hr. as fine powders.

EXAMPLE 7

The same pulverizable raw material powders as used in Example 1 were supplied from the raw material powder supply inlet at a rate of 35 kg/hr into a collision-type, gas current pulverizer with the same structure under the same conditions as in Example 3.

The pulverized product was transported to the classifying separator to withdraw the fine powders as the classified powders, whereas the coarse powders were returned into the acceleration pipe 3 together with the pulverizable raw material powders from the inlet 1.

Pulverized powders having a weight average particle size of 11.0 μm [measured by a coulter counter (aperture: 100 μm)] were recovered at a rate of 35 kg/hr. as fine powders.

Comparative Example 3

The same pulverizable raw material powders as used in Example 1 were supplied from the raw material powder supply inlet at a rate of 28 kg/hr. into a collision-type, gas current pulverizer with the same structure under the same conditions as in Comparative Example 1.

The pulverized product was transported to the classifying separator to withdraw the fine powders as the classified powders, whereas the coarse powders were returned into the acceleration pipe 43 together with the pulverizable raw material powders from the inlet 1.

Pulverized powders having a weight average particle size of 11.0 μm [measured by a coulter counter (aperture: 100 μm)] were recovered at a rate of 28 kg/hr. as fine powders.

The results of Examples 1 to 7 and Comparative Examples 1 to 3 are shown in Table 1.

TABLE 1

| | Weight average particle size of the resulting fine powders (μm) | Flow rate of supplied high pressure air (including secondary air) ($Nm^3$/min) | Pulverization capacity (kg/hr.) | Pulverization capacity per 1 $Nm^3$/min. of flow rate of supplied high pressure air (kg/hr.) | Treating capacity ratio |
|---|---|---|---|---|---|
| Ex.1 | 6.0 | 6.8 | 15.0 | 2.21 | 1.26*1) |
| Ex. 2 | 6.0 | 6.8 | 16.0 | 2.35 | 1.34*1) |
| Ex. 3 | 6.0 | 7.0 | 19.0 | 2.71 | 1.54*1) |
| Comp. Ex. 1 | 6.0 | 6.8 | 12.0 | 1.76 | 1 |
| Ex. 4 | 7.5 | 6.8 | 20.0 | 2.94 | 1.21*2) |
| Ex. 5 | 7.5 | 7.0 | 24.0 | 3.43 | 1.41*2) |
| Comp. Ex. 2 | 7.5 | 6.8 | 16.5 | 2.43 | 1 |
| Ex. 6 | 11.0 | 6.8 | 32.0 | 4.71 | 1.14*3) |
| Ex. 7 | 11.0 | 7.0 | 35.0 | 5.00 | 1.21*3) |
| Comp. Ex. 3 | 11.0 | 6.8 | 28.0 | 4.12 | 1 |

*1)Treating capacity ratio on presumption that the pulverization capacity per 1 $Nm^3$/min. of the flow rate of supplied high pressure air in Comp. Ex. 1 is made to be 1.
*2)Treating capacity ratio on presumption that the pulverization capacity per 1 $Nm^3$/min. of the flow rate of supplied high pressure air in Comp. Ex. 2 is made to be 1.
*3)Treating capcaity ratio on presumption that the pulverization capacity per 1 $Nm^3$/min. of the flow rate of supplied high pressure air in Comp. Ex. 3 is made to be 1.

EXAMPLE 8

The same pulverizable raw material powders as used in Example 1 were pulverized in the same collision-type, gas current pulverizer by the same process scheme as shown in FIG. 1.

A fixed wall type, pneumatic classifying separator was used as a classifying means for classifying the pulverized product into fine powders and coarse powders.

The acceleration pipe of the collision-type, gas current pulverizer had the following dimensions in FIG. 2:

$$x=80\text{ mm},\ y=55\text{ mm}\ (y/x\approx 0.69\text{ and }\psi=45^\circ$$

The acceleration pipe had secondary air inlets at 8 positions as shown in FIG. 3.

A compressed air was introduced from the compressed gas supply nozzle at a flow rate "a" of 6.4 $Nm^3$/min. (6.0 kg/$cm^2$), and a compressed secondary air was introduced from 6 positions A, B, C, E, H and G in FIG. 3 (D and F were closed) each at a flow rate of 0.1 $Nm^3/min.$ (6.0 kg/$cm^2$ ).

$$\frac{\text{Flow rate of secondary air "}b\text{"}}{\text{Flow rate of high pressure gas "}a\text{"}} = \frac{0.1 \times 6}{6.4} \simeq 0.09$$

The pulverizable raw material powders were supplied from the raw material powder inlet at a rate of 18.0 kg/hr. The pulverized product was transported to the classifying separator to remove the fine powders as the classified powders, whereas the coarse powders were returned to the acceleration pipe together with the pulverizable raw material powders to the inlet 1.

Pulverized powders having a weight average particle size of 6.0 μm [measured by a coulter counter (aperture: 100 μm)] were collected at a rate of fine powders at a rate of 18.0 kg/hr.

EXAMPLE 9

The same pulverizable raw material powders as used in Example 1 were pulverized in the same flow scheme as shown in FIG. 1.

A fixed wall type, pneumatic classifying separator was used as a classifying means to classifying the pulverized product into fine powders and coarse powders.

The acceleration pipe of the collision-type, gas current pulverizer had the following dimensions in FIG. 2.

$$x = 80\text{ mm},\ y = 36\text{ mm}\left(\frac{y}{x} \simeq 0.45\right)\text{and }\psi = 45^\circ$$

The acceleration pipe had secondary air inlets at 8 positions as shown in FIG. 3.

Compressed air was introduced from the compressed gas supply nozzle at a flow rate "a" of 6.4 $Nm^3$/min. (6.0 kg/$cm^2$), and a compressed secondary air was introduced from 6 positions A, B, C, E, H and G in FIG. 3 (D and F were closed) each at a flowrate of 0.1 $Nm^3$/min. (6.0 kg/$cm^2$).

$$\frac{\text{Flow rate of secondary air "}b\text{"}}{\text{Flow rate of high pressure gas "}a\text{"}} = \frac{0.1 \times 6}{6.4} \simeq 0.09$$

The pulverizable raw material powders were supplied from the raw material powder inlet at a rate of 17.0 kg/hr. The pulverized product was transported to the classifying separator to remove the fine powders as the classified powders, whereas the coarse powders were returned to the acceleration pipe together with the pulverizable raw material powders to the inlet 1.

Pulverized powders having a weight average particle size of 6.0 μm measured by a coulter counter (aperture: 100 μm) were collected at a rate of 17.0 kg/hr. of fine powders.

EXAMPLE 10

The same pulverizable raw material powders as used in Example 1 were pulverized in the same collision-type, gas current pulverizer by the same process scheme as shown in FIG. 1.

A fixed wall type, pneumatic classifying separator was used as a classifying means for classifying the pulverized product into fine powders and coarse powders.

The acceleration pipe of the collision-type, gas current pulverizer had the following dimensions in FIG. 2:

$$x = 80 \text{ mm}, y = 45 \text{ mm} \left(\frac{y}{x} \simeq 0.56\right) \text{and } \psi = 45°$$

The acceleration pipe had secondary air inlets at 8 positions as shown in FIG. 3.

Compressed air was introduced from the compressed gas supply nozzle at a flow rate "a" of 6.4 $Nm^3$/min. (6.0 kg/$cm^2$), and the atmospheric air as a compressed secondary air was introduced from 4 positions A, C, E and G in FIG. 3 as open inlets (B, D, F and H were closed).

The pulverizable raw material powders were supplied from the raw material powder inlet at a rate of 13 kg/hr. The pulverized product was transported to the classifying separator to remove the fine powders as the classified powders whereas the coarse powders were returned to the acceleration pipe together with the pulverizable raw material powders to the inlet 1.

Pulverized powders having a weight particle size of 6.0 μm [measured by a coulter counter (aperture: 100 μm)] were collected at a rate of 13 kg/hr, and the pulverization capacity was larger as compared with Comparative Example 1.

EXAMPLE 11

| | |
|---|---|
| Styrene-butyl acrylate copolymer | 100 parts by weight |
| Magnetite | 70 parts by weight |
| Nigrosine | 2 parts by weight |
| Low molecular weight polyethylene resin | 3 parts by weight |

were mixed in a Henschel mixer to prepare a raw material mixture. Then, the mixture was kneaded in an extruder, then cooled by a cooling roller and subjected to coarse pulverization to particles having particle sizes of 100 to 1,000 μm by a hammer mill. The thus obtained crude pulverized product was pulverized as pulverizable raw material powders by a flow scheme shown in FIG. 5.

A rotating vane-type, pneumatic classifying separator was used as a means for classifying the pulverized product into fine powders and coarse powders.

The acceleration pipe of the collision-type, gas current pulverizer had the following dimension in FIG. 6:

$$x = 80 \text{ mm}, y = 45 \text{ mm} \left(\frac{y}{x} \simeq 0.56\right) \text{and } \psi = 45°$$

The acceleration pipe had secondary air inlets at 8 position in the circumferential direction in FIG. 3.

A compressed air was introduced from the compressed air supply nozzle at a flow rate "a" of 6.2 $Nm^3$/min (6.0 kg/$cm^2$) and a compressed secondary air was introduced from 4 positions A, C, E and G in FIG. 3 (the positions B, D, F and H were all closed) each at a flow rate of 0.1 $Nm^3$/min (6.0 kg/$cm^2$).

$$\frac{b}{a} = \frac{0.1 \times 4}{6.2} \simeq 0.065$$

The classification point of the rotating vane-type, pneumatic classifying separator was set so that the volume average particle size of fine powders could be 7.5 μm. The pulverizable raw material powders were supplied at a rate of 25 kg/hr. from the raw material powder inlet 1. The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 7.5 μm was recovered at a rate of 25 kg/hr. as fine powders. No generation of fused product was observed at all even during a continuous operation for 3 hours.

The particle size distribution of powders can be measured by various methods, but by a coulter counter in the present invention. As a coulter counter, a coulter counter type Ta-II (made by Coulter Co.) was used and was connected to an interface for outputting a particle number distribution and a volume distribution (made by Nikkaki K.K.) and CX-1 personal computer (made by Canon). As an electrolytic solution, an aqueous 1% NaCl solution was prepared by dissolving first grade sodium chloride into water. The measurement was carried out by adding 0.1 to 5 ml of a surfactant as a dispersing agent, preferably alkylbenzene sulfonate, to 100 to 150 ml of the aqueous electrolytic solution, further adding thereto 2 to 20 ml of a sample to be measured, subjecting the electrolytic solution containing the sample in a suspended state to a dispersion treatment for about 1 to about 3 minutes, measuring particle size distribution of particles having particle sizes of 2 to 40 μm on the basis of the particle number with the coulter counter, type TA-II, with a 100 μm aperture, and obtaining the values pertaining to the present invention from the measurements.

EXAMPLE 12

The same pulverizable raw material powders as used in Example 11 were pulverized in the same collision-type, gas current pulverizer by the flow scheme as shown in FIG. 5.

A rotating vane-type pneumatic classifier was used as a classifying means for classifying the pulverization product into fine powders and coarse powders.

The acceleration pipe of the collision-type, gas current pulverizer had the following dimensions in FIG. 6:

$$x = 80 \text{ mm}, y = 45 \text{ mm} \left(\frac{y}{x} \simeq 0.56\right) \text{ and } \psi = 55°$$

The secondary air inlets were the same as in Example 11.

Compressed air was introduced from the compressed gas supply nozzle at a rate "a" of 6.2 $Nm^3$/min. (6.0 $kg/cm^2$), and secondary compressed air was introduced from 4 positions A, C, E and G in FIG. 3 (the positions B, D, F and H were all closed) each at a rate "b" of 0.1 $Nm^3$/min. (6.0 $kg/cm^2$).

$$\frac{b}{a} = \frac{0.1 \times 4}{6.2} \simeq 0.065$$

The classification point of the rotating vane-type, pneumatic classifying separator was set so that the volume average particle size of fine powders could be 7.5 μm. The pulverizable raw material powders were supplied at a rate of 24 kg/hr. from the raw material powder inlet 1. The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 7.5 μm was recovered at a rate of 24 kg/hr. as fine powders.

EXAMPLE 13

The same pulverizable raw material powders as used in Example 11 were pulverized by the same flow scheme as shown in FIG. 5.

A rotating vane-type, pneumatic classifying separator was used as a classifying means for classifying the pulverization product into fine powders and coarse powders.

The acceleration pipe of the collision-type, gas current pulverizer had the following dimensions in FIG. 6:

$$x = 80 \text{ mm}, y = 45 \text{ mm} \left(\frac{y}{x} \simeq 0.56\right) \text{and } \psi = 45°$$

The secondary air inlets were the same as used in Example 11.

Compressed air was introduced from the compressed gas supply nozzle at a flow rate "a" of 6.2 $Nm^3$/min. (6.0 $kg/cm^2$), and compressed secondary air was introduced from 6 positions, A, B, C, E, H and G (the positions D and F were closed) each at a flow rate "b" of 0.1 $Nm^3$/min. (6.0 $kg/cm^2$).

$$\frac{b}{a} = \frac{0.1 \times 6}{6.2} \simeq 0.097$$

The classification point of the rotating vane-type, pneumatic classifying separator was set so that the volume average particle size of fine powders could be 7.5 μm. The pulverizable raw material powders were supplied from the raw material powder supply inlet 1 at a rate of 26 kg/hr. The pulverization product was transported to the classifying separator to withdraw the fine powders as classified powders, whereas the coarse powders were returned to the acceleration pipe together with the pulverizable raw material powder to the inlet 1.

The pulverization product having a volume average particle size of 7.5 μm as fine powders was recovered at a rate of 26 kg/hr.

Comparative Example 4

Figure 8:
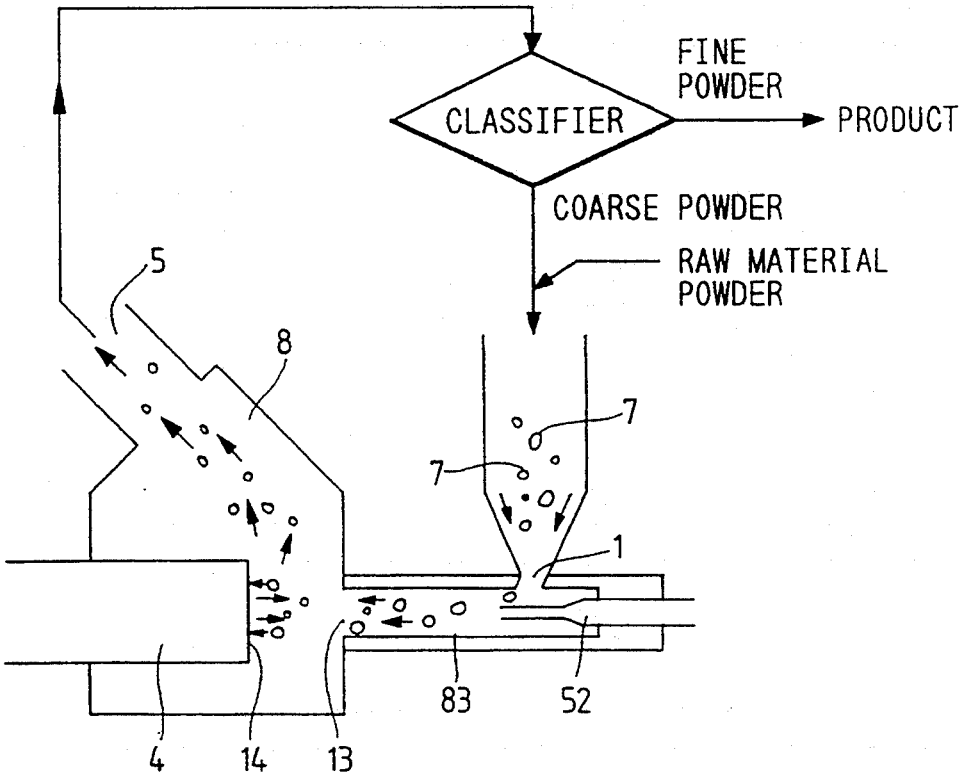
FIG. 8 PRIOR ART
FIG. 8 is a schematic cross-sectional view of another collision-type, gas current pulverizer according to the prior art as used in a process for pulverization based on a combination of a pulverization step using the prior art pulverizer and a classification step using a classifying separator shown in the form of a flow diagram.

The same pulverizable raw material powders as used in Example 11 were pulverized in the same collision-type, gas current pulverizer by the same flow scheme as shown in FIG. 8.

A rotating vane-type, pneumatic classifying separator was used as a classifying means for classifying the pulverization product into fine powders and coarse powders.

Compressed air was introduced into the acceleration pipe of the collision-type pneumatic pulverizer from the compressed gas supply nozzle at a rate of 6.6 $Nm^3$/min. (6.0 $kg/cm^2$), and the classification point of the rotating vane-type, pneumatic classifying separator was set so that the volume average particle size of fine powders could be 7.5 μm. The pulverizable raw material powders were supplied from the raw material powder supply inlet 1 at a rate of 14 kg/hr. The resulting pulverization product was transported to the classifying separator to withdraw the fine powders as the classified powders, whereas the coarse powders were returned to the acceleration pipe together with the pulverizable raw material powders from the inlet 1.

A fine pulverization product having a volume average particle size of 7.5 μm was recovered as fine powders; at a rate of 14 kg/hr.

EXAMPLE 14

The same pulverizable raw material powders as used in Example 11 were supplied into a collision-type, gas current pulverizer of the same structure by the same process scheme as in Example 11 from the raw material powder inlet 1 at a rate of 28 kg/hr.

The classification point of the pneumatic classifying separator was set so that the volume average particle size of fine powders could be 8.5 μm.

The resulting pulverization product was transported to the classifying separator to withdraw the fine powders as the classified powders, whereas the coarse powders were returned to the acceleration pipe together with the pulverizable raw material powders from the inlet 1. The pulverization product having a volume average particle size of 8.5 μm was recovered as fine powders at a rate of 28 kg/hr.

EXAMPLE 15

The same pulverizable raw material powders as used in Example 11 were supplied into a collision-type, gas current pulverizer of the same structure by the same process scheme as in Example 13 from the raw material powder inlet 1 at a rate of 29 kg/hr.

The classification point of the pneumatic classifying separator was set so that the volume average particle size of fine powders could be 8.5 μm.

The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 8.5 μm was recovered as fine powders at a rate of 29 kg/hr.

Comparative Example 5

The same pulverizable raw material powders as used in Example 11 were supplied into a collision-type, gas current pulverizer of the same structure by the same process scheme as in Comparative Example 4 from the raw material powder inlet 1 at a rate of 17 kg/hr.

The classification point of the pneumatic classifying separator was set so that the volume average particle size could be 8.5 μm.

The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 8.5 μm was recovered as fine powders at a rate of 17 kg/hr.

EXAMPLE 16

The same pulverizable raw material powders as used in Example 11 were supplied into a collision-type, gas current pulverizer of the same structure by the same process scheme as in Example 11 from the raw material powder inlet 1 at a rate of 32 kg/hr.

The classification point of the pneumatic classifying separator was set so that the volume average particle size of fine powders could be 9.5 μm.

The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 9.5 μm was recovered as fine powders at a rate of 32 kg/hr.

EXAMPLE 17

The same pulverizable raw material powders as used in Example 11 were supplied into a collision-type, gas current pulverizer of the same structure by the same process scheme as in Example 13 from the raw material inlet 1 at a rate of 33 kg/hr.

The classification point of the pneumatic classifying separator was set so that the volume average particle size of fine powders could be 9.5 μm.

The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 9.5 μm was recovered as fine powders at a rate of 33 kg/hr.

Comparative Example 6

The same pulverizable raw material powders as used in Example 11 were supplied into collision-type, gas current pulverizer of the same structure by the same process scheme as in Comparative Example 4 from the raw material powder inlet 1 at a rate of 21 kg/hr.

The classification point of the pneumatic classifying separator was set so that the volume average particle size of fine powders could be 9.5 μm.

The resulting pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 9.5 μm was recovered as fine powders at a rate of 21 kg/hr.

The results of Examples 11 to 17 and Comparative Examples 4 to 6 are shown in Table 2.

TABLE 2

| | Volume average particle size of the resulting fine powders (μm) | Flow rate of supplied high presure air (including secondary air) ($Nm^3$/min) | Pulverization capacity (kg/hr.) | Pulverization capacity per 1 $Nm^3$/min of the flow rate of supplied high pressure air (kg/hr.) | Treating capacity ratio |
|---|---|---|---|---|---|
| Ex. 11 | 7.5 | 6.6 | 25.0 | 3.78 | 1.79*1) |
| Ex. 12 | 7.5 | 6.6 | 24.0 | 3.64 | 1.71*1) |
| Ex. 13 | 7.5 | 6.8 | 26.0 | 3.82 | 1.86*1) |
| Comp. Ex. 4 | 7.5 | 6.6 | 14.0 | 2.12 | 1 |
| Ex. 14 | 8.5 | 6.6 | 28.0 | 4.24 | 1.65*2) |
| Ex. 15 | 8.5 | 6.8 | 29.0 | 4.26 | 1.71*2) |
| Comp. Ex. 5 | 8.5 | 6.6 | 17.0 | 2.58 | 1 |
| Ex. 16 | 9.5 | 6.6 | 32.0 | 4.84 | 1.52*3) |
| Ex. 17 | 9.5 | 6.8 | 33.0 | 4.85 | 1.57*3) |
| Comp. Ex. 6 | 9.5 | 6.6 | 21.0 | 3.18 | 1 |

*1)Treating capacity ratio on presumption that the pulverization capacity per 1 $Nm^3$/min. of the flow rate of supplied high pressure air in Comp. Ex. 4 is made to be 1.
*2)Treating capacity ratio on presumption that the pulverization capacity per 1 $Nm^3$/min. of the flow rate of supplied high pressure air in Comp. Ex. 5 is made to be 1.
*3)Treating capcaity ratio on presumption that the pulverization capacity per 1 $Nm^3$/min. of the flow rate of supplied high pressure air in Comp. Ex. 6 is made to be 1.

Example 18

The same pulverizable raw material powders as used in Example 11 were pulverized by the same flow scheme as shown in FIG. 5.

A rotating vane-type, pneumatic classifying separator was used as a classifying means for classifying the pulverization product into fine powders and coarse powders.

The acceleration pipe of the collision-type, gas current pulverizer had the following dimensions in FIG. 2:

$x=80$ mm, $y=55$ mm ($y/x \approx 0.69$) and $\psi=45°$

The secondary air inlets were the same as used in Example 11.

Compressed air was introduced from the compression gas supply nozzle at a flow rate "a" of 6.2 $Nm^3$min. (6.0 $kg/cm^2$), and a compressed secondary air was introduced from 6 positions A, B, C, E, H and G in FIG. 3 (D and F were closed) each at a flow rate of 0.1 $Nm^3$/min. (6.0 $kg/cm^2$).

$$\frac{b}{a} = \frac{0.1 \times 6}{6.2} \simeq 0.097$$

The classification point of the rotating vane-type, pneumatic classifying separator was set so that the volume average particle size could be 7.5 μm.

The pulverizable raw material powders were supplied from the raw material powder supply inlet 1 at a rate of 26.0 kg/hr. The pulverization product was transported to the classifying separator to withdraw the fine powders as the classified powders, whereas the coarse powders were returned to the acceleration pipe together with the pulverizable raw material powders from the inlet.

The pulverization product having a volume average particle size of 7.5 μm [measured by a Coulter counter (aperture: 100 μm)] was recovered as fine powders at a rate of 26.0 kg/hr.

EXAMPLE 19

The same pulverizable raw material powders as used in Example 11 were pulverized by the same flow scheme as shown in FIG. 5.

A rotating vane-type, pneumatic classifying separator was used as a classifying means for classifying the pulverization product into fine powders and coarse powders.

The acceleration pipe of the collision-type, gas current pulverizer had the following dimensions in FIG. 6.

$$x = 80 \text{ mm}, y = 36 \text{ mm} \left(\frac{y}{x} \simeq 0.45\right) \text{and } \psi = 45°$$

The secondary air inlets were the same as used in Example 11.

Compressed air was introduced from the compression gas supply nozzle at a flow rate "a" of 6.2 $Nm^3$/min. (6.0 $kg/cm^2$), and a compressed secondary air was introduced from 6 positions A, B, C, E, H and G in FIG. 3 (D and F were closed) each at a flow rate of 0.1 $Nm^3$/min (6.0 $kg/cm^2$).

$$\frac{b}{a} = \frac{0.1 \times 6}{6.2} \simeq 0.097$$

The classification point of the rotating vane-type, pneumatic classifying separator was set so that the volume average particle size could be 7.5 μm.

The pulverizable raw material powders were supplied from the raw material powder supply inlet 1 at a rate of 24.0 kg/hr. The pulverization product was transported to the classifying separator to withdraw the fine powders as the classified powders, whereas the coarse powders were returned to the acceleration pipe together with the pulverizable raw material powders from the inlet 1.

The pulverized product having a volume average particle size of 7.5 μm [measured by a Coulter counter (aperture: 100 μm)] was recovered as fine powders at a rate 24.0 kg/hr.

EXAMPLE 20

The same pulverizable raw material powders as used in Example 11 were pulverized by the same flow scheme as shown in FIG. 5.

A rotating vane-type, pneumatic classifying separator was used as a classifying means for classifying the pulverization product into fine powders and coarse powders.

The acceleration pipe of the collision-type, gas current pulverizer had the following dimensions in FIG. 6:

$$x = 80 \text{ mm}, y = 45 \text{ mm} \left(\frac{y}{x} \simeq 0.56\right) \text{and } \psi = 45°$$

The secondary air inlets were the same as used in Example 11.

Compressed air was introduced from the compression gas supply nozzle at a flow rate "a" of 6.2 $Nm^3$/min. (6.0 $kg/cm^2$), and the atmospheric air as a secondary air was introduced from 4 positions A, C, E and G in FIG. 3 (B, D, F, and H were closed) as open inlets.

The classification point of the rotating vane-type, pneumatic classifying separator was set so that the volume average particle size could be 7.5 μm.

The pulverizable raw material powders were supplied from the raw material powder supply inlet 1 at a rate of 15.5 kg/hr. The pulverization product was transported to the classifying separator to withdraw the fine powders as the classified powders, whereas the coarse powders were returned to the acceleration pipe together with the pulverizable raw material powders from the inlet 1.

The pulverization product having a volume average particle size of 7.5 μm [measured by a Coulter counter (aperture: 100 μm)] was recovered as fine powders at a rate of 15.5 kg/hr. The pulverization capacity was larger than that of Comparative Example 4.

EXAMPLE 21

Pulverizable raw material powders were pulverized in a collision-type, gas current pulverizer by a flow scheme shown in FIGS. 9 to 12.

A rotating vane-type, pneumatic classifying separator was used as a classifying means for classifying the pulverization product into fine powders and coarse powders.

The collision-type, gas current pulverizer had an acceleration pipe 3 with an outlet inner diameter of 25 mm and satisfied the following conditions in FIGS. 11 and 12:

| |
|---|
| $\times = 80$ mm, $y = 45$ mm and $\psi$ 45°<br>secondary air inlets 11 at 8 positions in the circumferential direction. |

The collision member 26 was in a columnar shape and composed of aluminum oxide ceramics, 60 mm in diameter, and the collision surface 27 was in a conical shape with an apex angle 160° at the tip end. The center axis of the acceleration pipe 3 was in agreement with the tip end of the collision member 26. The closest distance between the outlet 13 of the acceleration pipe and the collision surface 27 was 60 mm, and the closest distance between the collision member 26 and the wall 28 of the pulverization chamber was 18 mm.

The pulverizable raw materials powders were prepared from the following components:

| | |
|---|---|
| Polyester resin (weight average molecular weight (MW) = 50,000; Tg = 60° C.) | 100 parts by weight |
| Phthalocyanine-based pigment | 6 parts by weight |
| Low molecular weight polyethylene | 2 parts by weight |
| Negative charge-controlling agent (Azo-based metal complex) | 2 parts by weight |

The toner raw materials composed of the foregoing components in mixture were melt-kneaded at about 180° C. for about 1.0 hour, then cooled and solidified. Then, the cooled kneaded product was coarsely pulverized to particles having particle sizes of 100 to 1,000 μm by a hammer mill to obtain the pulverizable raw material powders.

Compressed air was introduced from the compressed gas supply nozzle 2 at a flow rate of 4.6 $Nm^3$/min (6 $kg/cm^2$) and a compressed secondary air was introduced from 6 positions F, G, H, J, L and M in FIG. 12 (I and K were closed) each at a flow rate of 0.05 $Nm^3$/min. (6 $kg/cm^2$).

The pulverizable raw material powders were supplied from the raw material powder supply inlet 1 at a rate of 18 kg/hr. The pulverization product was smoothly transported from the discharge outlet 29 to the classifying separator to remove the fine powders as the classified powders (pulverization product), whereas the coarse powders were returned to the acceleration pipe together with the pulverizable raw material powders from the raw material powder supply inlet 1. The pulverization product having a weight average particle size of 6 μm was recovered as fine powders at a rate of 18 kg/hr.

The pulverization efficiency was improved owing to supply of the secondary air to the acceleration pipe and use of a conical shape with an apex angle of 160° as the collision surface of the collision member, and furthermore the pulverization capacity was much enhanced, as compared with that of the conventional system, without fusion or aggregation around the collision member.

The pulverization rate for producing the pulverization product having a weight average particle size of 11 μm as fine powders was at 36 kg/hr.

EXAMPLE 22

The same pulverizable raw material powders used in Example 21 were pulverized in the same manner as in Example 21 in a collision-type, gas current pulverizer having an acceleration pipe outlet 13 with an inner diameter of 25 mm and satisfying the following conditions in FIGS. 11 and 12:

| |
|---|
| $\times$ = 80 mm, y = 45 mm and $\psi$ = 45° The secondary air inlets at 8 positions in the circumferential direction |

-continued with a collision member whose collision surface was in a conical shape with an apex angle of 120°, by introducing compressed air from the compressed air supply nozzle at a rate of 4.6 $Nm^3$/min (6 $kg/cm^2$) and a compressed secondary air from 6 positions F, G, H, J, L and[M in FIG. 12 (I and K were closed) each at a flow rate of 0.05 $Nm^3$/min (6 $kg/cm^2$).

The pulverization product having a weight average particle size of 6 μm was recovered as fine powders at a rate of 17 kg/hr. In case of producing fine powders having a weight average particle size of 11 μm as a pulverization product, the fine powders were obtained at a rate of 33 kg/hr. The supply rate of the pulverizable raw material powders was adjusted in accordance with the treating capacity.

EXAMPLE 23

The same pulverizable raw material powders used in Example 21 were pulverized in the same manner as in Example 21 in a collision-type, gas current pulverizer having an acceleration pipe outlet 13 with an inner diameter of 25 mm and satisfying the following conditions in FIGS. 11 and 12:

| |
|---|
| $\times$ = 80 mm, y = 45 mm and $\psi$ = 60° The secondary air inlets at 8 positions in the circumferential direction |

with a collision member whose collision surface was in a conical shape with an apex angle of 160°, by introducing compressed air from the compressed air supply nozzle at a rate of 4.6 $Nm^3$/min (6 $kg/cm^2$) and compressed secondary air from 4 positions F, H, J, L in FIG. 12 (G, I, K and M were closed) each at a flow rate of 0.05 $Nm^3$/min (6 $kg/cm^2$).

The pulverization product having a weight average particle size of 6 μm was recovered as fine powders at a rate of 14 kg/hr. The supply rate of the pulverizable raw material powders was adjusted in accordance with treating capacity. In case of producing fine powders having a weight average particle size of 11 μm as a pulverization product, the fine powders were obtained at a rate of 33 kg/hr.

Comparative Example 17

The same pulverizable raw material powders as used in Example 21 were pulverized in a conventional collision-type, gas current pulverizer shown in FIG. 4. In the pulverizer, the collision surface 14 at the tip end of the collision member 4 was a flat surface perpendicular to the axial direction of the acceleration pipe 43, and the inner diameter of the outlet 13 of the acceleration pipe was 25 mm. Pulverization was carried out by supplying compressed gas into the acceleration pipe 43 from the compressed gas supply nozzle at a flow rate of 4.6 $Nm^3$/min. (6 $kg/cm^2$), and setting the classifying separator so that fine powders as a pulverization product could have a weight average particle size of 6 μm .

The pulverized or pulverizable raw material powders colliding with the collision surface 14 were rebounded in the direction opposite to the ejecting direction of the acceleration pipe, and thus the concentration of the pulverized or pulverizable raw materials prevailing around the collision surface was considerably high. Thus, when the supply rate of the pulverizable raw material powders exceeded 4.5 kg/hr, fusion products and aggregation products started to form on the collision member, resulting in clogging in the pulverization chamber or the classifying separator with the fusion products. Thus, the treating capacity was obliged to be reduced to such a rate as 4.5 kg/hr., which was a limit to the pulverization capacity.

In case of pulverization to obtain fine powders having a weight average particle size of 11 μm as a pulverization product, fusion products and aggregation products started to form on the collision member when the supply rate of the pulverizable raw material powders exceeded a rate of 9 kg/hr. which was a limit to the pulverization capacity.

Comparative Example 8

The pulverizable raw material powders as used in Example 21 were pulverized in the same manner as in Comparative Example 7 in a collision-type, gas current pulverizer as shown in FIG. 13. The pulverizer was the same pulverizer as used in Comparative Example 7, except that the collision surface 27 at the tip end of the collision member 66 was inclined at an angle of 45° to the axial direction of the acceleration pipe 63. The pulverized or pulverizable powders colliding with the collision surface were rebounded in the leaving direction from the outlet 13 of the acceleration pipe, as compared with comparative Example 7, and thus no fusion products nor aggregation products were formed. However, the force of collision was weaker at the collision with the collision surface, resulting in poor pulverization efficiency, and thus fine powders having a weight average particle size of 6 μm as a pulverization product were obtained at a rate of about 4.5 kg/hr.

In case of obtaining fine powders having a weight average particle size of 11 μm as a pulverization product, the fine powders were obtained only at a rate of about 9 kg/hr.

Comparative Example 9

The same pulverizable raw material powder as used in Example 21 were pulverized in the same manner as in Comparative Example 7 in a collision-type, gas current pulverizer having an acceleration pipe outlet 14 with an inner diameter of 25 mm, the collision surface of whose collision member was in a conical shape with an apex angle of 160°.

The pulverized or pulverizable powders colliding with the collision surface were not fused or aggregated around the collision member, because the collision surface was in a conical shape with an apex angle of 160°, and fine powders having a weight average particle size of 6 μm as a pulverization product were obtained at a rate of 11 kg/hr.

In case of obtaining fine powders having a weight average particle size of 11 μm as a pulverization product, the fine particles were produced at a rate of 29 kg/hr. However, a higher pulverization efficiency than those of Examples 21 to 23 were not obtained.

The results of Examples 21 to 23 and Comparative Examples 7 and 8 are shown in the following Tables 3-1 and 3-2.

TABLE 3-1

| | Structure of pulverizer and pulverizing conditions | | |
|---|---|---|---|
| | Secondary air introduction into acceleration pipe | Shape of collision surface of collision member | Flow rate of supplied high pressure air (including secondary air) [$Nm^3$/min] |
| Ex. 21 | Inlet angle ψ = 45°, 6 positions of 160° | Cone with an apex angle | 4.9 |
| Ex. 22 | Inlet angle ψ = 45°, 6 positions of 120° | Cone with an apex angle | 4.9 |
| Ex. 23 | Inlet angle ψ = 60°, 4 positions of 160° | Cone with an apex angle | 4.8 |
| Comp. Ex. 7 | — | Plane perpendicular to the axial direction of acceleration pipe | 4.6 |
| Comp. Ex. 8 | — | Plane at an angle of 45° to the axial direction of acceleration pipe | 4.6 |
| Comp. Ex. 9 | — | Cone with an apex angle of 160° | 4.6 |

TABLE 3-2

| | Pluverization capacity | | | | | |
|---|---|---|---|---|---|---|
| | Production of fine powders*1) with particles size of 6 μm | | | Production of fine powders*1) with particle size of 11 μm | | |
| | Treating capacity [kg/hr] | Treating capacity per 1 $Nm^3$/min. of the flow rate of supplied high pressure air [kg/hr] | Treating *2) capacity ratio | Treating capacity [kg/hr] | Treating capacity per 1 $Nm^3$/min. of the flow rate of supplied high pressure air [kg/hr] | Treating*2) capacity ratio |
| Ex. 21 | 18 | 3.67 | 3.7 | 36 | 7.35 | 3.8 |
| Ex. 22 | 17 | 3.47 | 3.5 | 33 | 6.73 | 3.4 |
| Ex. 23 | 14 | 2.92 | 3.0 | 33 | 6.88 | 3.5 |
| Comp. Ex. 7 | 4.5 | 0.98 | 1.0 | 9 | 1.96 | 1.0 |
| Comp. Ex. 8 | 4.5 | 0.98 | 1.0 | 9 | 1.96 | 1.0 |
| Comp. Ex. 9 | 11 | 2.39 | 2.4 | 29 | 6.30 | 3.2 |

*1)Weight average particle size
*2)Treating capacity ratio per 1 $Nm^3$/min. of the flow rate of supplied high pressure air on the basis of Comp. Ex. 7 as 1.0.

EXAMPLE 24

Pulverizable raw materials were prepared from the following components:

| | |
|---|---|
| Styrene-acrylic resin (MW = 200,000; Tg = 60° C.) | 100 parts by weight |
| Magnetic powders (magnetite, average (partio size: 0.3 μm)) | 60 parts by weight |
| Low molecular weight polypropylene resin | 4 parts by weight |
| Negative charge-controlling agent | 2 parts by |

-continued

| | weight |
|---|---|

A mixture composed of the foregoing components as toner raw materials was melt-kneaded at about 180° C. for about 1.0 hour, then cooled and solidified. The solidified mixture was roughly pulverized to particles having particle sizes of 100 to 1,000 μm by a hammer mill to obtain the pulverizable raw material powders, which were pulverized in the same collision-type, gas current pulverizer as used in Example 21 under the same conditions as in Example 21.

Structure of the pulverizer and pulverizing conditions are summarized as follows:

| | | |
|---|---|---|
| Structure: | Acceleration pipe | Outlet inner diameter: 25 mm $\times$ = 80 mm, y = 45 mm and $\psi$ = 45° |
| | Collision member: | Conical shape with a collision surface at an apex angle of 160° |
| Conditions: | Compressed gas was introduced from compressed gas supply nozzle at a flow rate of 4.6 $Nm^3$/min (6 kg/$cm^2$) compressed secondary air was introduced from 6 positions F, G, H, J, L and M in FIG. 12 (I and K were closed) each at a flow rate of 0.05 $Nm^3$/min (6 kg/$cm^2$). | |

In case of obtaining a pulverization product having a weight average particle size distribution of 6 μm as fine powders, the pulverization capacity was at a rate of 16.5 kg/hr. In case of obtaining a pulverization product having a weight average particle size of 11 μm, the pulverization capacity was at 34 kg/hr.

EXAMPLE 25

The pulverizable raw material powders as used in Example 24 were pulverized in a collision-type, gas current pulverizer with the same structure under the same conditions as in Example 22.

The structure of the pulverizer and the pulverization conditions are summarized as follows:

| | | |
|---|---|---|
| Structure: | Acceleration pipe | Outlet inner diameter: 25 mm $\times$ = 80 mm, y = 45 mm and $\psi$ = 45° |
| | Collision member: | Conical shape with a collision surface at an apex angle of 120° |
| Conditions: | Compressed air was supplied from the compressed gas supply nozzle at a flow rate of 4.6 $Nm^3$/min. (6 kg/$cm^2$) and compressed secondary air was supplied from 6 locations, F, G, H, J, L and M in FIG. 12 (I and K were closed) each at a flow rate of 0.05 $Nm^3$/min. (6 kg/$cm^2$). | |

In case of obtaining a pulverization product having a weight average particle size of 6 μm as fine powders, the pulverization capacity was at a rate of 15.5 kg/hr. In case of obtaining a pulverization product having a weight average particle size of 11 μm, the pulverization capacity was at a rate of 31 kg/hr.

EXAMPLE 26

The pulverizable raw material powders as used in Example 24 were pulverized in a collision-type, gas current pulverizer with the same structure under the same conditions as in Example 23.

The structure of the pulverizer and the pulverization conditions are summarized as follows:

| | | |
|---|---|---|
| Structure: | Acceleration pipe | Outlet inner diameter: 25 mm $\times$ = 80 mm, y = 45 mm, $\psi$ = 60° |
| | Collision member: | Conical shape with a collision surface at an apex angle of 160° |
| Conditions: | Compressed air was supplied from the compressed gas supply nozzle at a flow rate of 4.6 $Nm^3$/min (6 kg/$cm^2$) and compressed secondary air was supplied from 4 positions F, H, J and L in FIG. 12 (G, I, K and M were closed) each at a flow rate of 0.05 $Nm^3$/min (6 kg/$cm^2$). | |

In case of obtaining a pulverization product having a weight average particle size of 6 μm as fine powders, the pulverization capacity was at a rate of 13 kg/hr. In case of obtaining a pulverization product having a weight average particle size of 11 μm, the pulverization capacity was at a rate of 31 kg/hr.

Comparative Example 10

The pulverizable raw material powders as used in Example 24 were pulverized in a collision-type, gas current pulverizer with the same structure under the same conditions as in Comparative Example 7.

The structure of the pulverizer and the pulverization conditions are summarized as follows:

| | | |
|---|---|---|
| Structure: | Acceleration pipe: | Outlet inner diameter: 25 mm |
| | Collision member: | The collision surface was a plane perpendicular to the axial direction of the acceleration pipe |
| Conditions: | Compressed air was supplied from the compressed gas supply nozzle at a flow rate of 4.6 $Nm^3$/min (6 kg/$cm^2$) | |

In case of obtaining a pulverization product having a weight average particle size of 6 μm as fine powders, the pulverization capacity was at a rate of 8 kg/hr. In case of obtaining a pulverization product having a weight average particle size of 11 μm, the pulverization capacity was at a rate of 19 kg/hr.

No such phenomena as fusion products and aggregation products were formed on the collision member were observed contrary to Comparative Example 7.

Comparative Example 11

The pulverization raw material powders as used in Example 24 were pulverized in a collision-type, gas current pulverizer with the same structure under the same conditions as in Comparative Example 8.

The structure of the pulverizer and the pulverization conditions are summarized as follows:

| | | |
|---|---|---|
| Structure: | Acceleration pipe: | Outlet inner diameter: 25 mm |
| | Collision member: | The collision surface was a plane inclined at 45° to the axial direction of the acceleration pipe |
| Conditions: | Compressed air was supplied from the compressed gas supply nozzle at a flow rate of 4.6 $Nm^3$/min (6 $kg/cm^2$) | |

In case of obtaining a pulverization product having a weight average particle size of 6 μm as fine powders, the pulverization capacity was at a rate of 5 kg/hr. In case of obtaining a pulverization product having a weight average particle size of 11 μm, the pulverization capacity was at a rate of 11 kg/hr.

Comparative Example 12

The pulverizable raw material powders as used in Example 24 were pulverized in a collision-type, gas current pulverizer with the same structure under the same conditions as in Comparative Example 10.

The structure of the pulverizer and the pulverization conditions are summarized as follows:

| | | |
|---|---|---|
| Structure: | Acceleration pipe: | Outlet inner diameter: 25 mm |
| | Collision member: | Conical shape with a collision surface at an apex angle of 160° |
| Conditions: | Compressed air was supplied from the compressed gas supply nozzle at a flow rate of 4.6 $Nm^3$/min (6 $kg/cm^2$) | |

In case of obtaining a pulverization product having a weight average particle size of 6 μm as fine powders, the pulverization capacity was at a rate of 0.5 kg/hr. In case of obtaining a pulverization product having a weight average particle size of 11 μm, the pulverization capacity was at a rate of 27 kg/hr.

As described above, the pulverization efficiency was improved in Examples 24 to 25, as compared with Comparative Examples 10 to 12. Particularly the pulverization efficiency was much more increased in case of obtaining a pulverized product having smaller particle sizes as fine powders.

The results of Examples 24 to 26 and Comparative Examples 10 to 12 are shown in Tables 4-1 and 4-2.

TABLE 3-1

| | Structure of pulverizer and pulverizing conditions | | |
|---|---|---|---|
| | Secondary air introduction into acceleration pipe | Shape of collision surface of collision member | Flow rate of supplied high pressure air (including secondary air) [$Nm^3$/min] |
| Ex. 24 | Inlet angle $\psi = 45°$, 6 positions of 160° | Cone with an apex angle | 4.9 |
| Ex. 25 | Inlet angle $\psi = 45°$, 6 positions of 120° | Cone with an apex angle | 4.9 |
| Ex. 26 | Inlet angle $\psi = 60°$, 4 positions of 160° | Cone with an apex angle | 4.8 |
| Comp. Ex. 10 | — | Plane perpendicular to the axial direction of acceleration pipe | 4.6 |
| Comp. Ex. 11 | — | Plane at an angle of 45° to the axial direction of acceleration pipe | 4.6 |
| Comp. Ex. 12 | — | Cone with an apex angle of 160° | 4.6 |

TABLE 4-2

| | Pluverization capacity | | | | | |
|---|---|---|---|---|---|---|
| | Production of fine powders*1) with particles size of 6 μm | | | Production of fine powders*1) with particle size of 11 μm | | |
| | Treating capacity [kg/hr] | Treating capacity per 1 $Nm^3$/min. of the flow rate of supplied high pressure air [kg/hr] | Treating *2) capacity ratio | Treating capacity [kg/hr] | Treating capacity per 1 $Nm^3$/min. of the flow rate of supplied high pressure air [kg/hr] | Treating*2) capacity ratio |
| Ex. 24 | 16.5 | 3.37 | 1.9 | 34 | 6.94 | 1.7 |
| Ex. 25 | 15.5 | 3.167 | 1.8 | 31 | 6.33 | 1.5 |
| Ex. 26 | 13 | 2.71 | 1.6 | 31 | 6.46 | 1.6 |
| Comp. Ex. 10 | 8 | 1.74 | 1.0 | 19 | 4.13 | 1.0 |
| Comp. Ex. 11 | 5 | 1.09 | 0.6 | 11 | 2.39 | 0.6 |
| Comp. Ex. 12 | 10.5 | 2.28 | 1.3 | 27 | 5.87 | 1.4 |

*1)Weight average particle size

*2)Treating capacity ratio per 1 $Nm^3$/min. of the flow rate of supplied high pressure air on the basis of Comp. Ex. 10 as 1.0.

EXAMPLE 27

Pulverizable raw material powders were pulverized in a collision-type, gas current pulverizer by a flow scheme shown in FIG. 15. A rotating vane-type, gas current classifying separator was used as a classifying means for classifying the pulverization product into fine powders and coarse powders.

The collision type, gas current pulverizer had an acceleration pipe 3 with an outlet 13, 25 mm in inner diameter, and satisfied the following conditions in FIGS. 11 and 12:

| |
|---|
| $x = 80$ mm, $y = 45$ mm ($y/x = 0.56$) and $\psi = 45°$ Secondary air inlets 10 at 8 positions in the circumferential direction, among which the 6 positions were used. |

The collision member 36 was in a circular columnar shape composed of aluminum oxide-based ceramics, 60 mm in diameter, and had a conical shape collision surface 37 at an apex angle of 160° at the tip end. The center axis of the acceleration pipe 3 was in agreement with the tip end of the collision member 36. The closest distance between the outlet 13 of the acceleration pipe and the collision surface 37 was 60 mm, and the closest distance between the collision member 36 and the wall 38 of the pulverization chamber was 18 mm. The pulverization chamber was in a circular cylindrical shape, 96 mm in inner diameter, as shown in FIG. 15A.

The pulverizable raw material powders were prepared from the following components:

| | |
|---|---|
| Polyester resin (weight average molecular weight (MW) = 50,000; Tg = 60° C.) | 100 parts by weight |
| Phthalocyanine-based pigment | 6 parts by weight |
| Low molecular weight polyethylene | 2 parts by weight |
| Negative charge-controlling agent (Azo-based metal complex) | 2 parts by weight |

Toner raw materials composed of the above-mentioned mixture were melt-kneaded at about 180° C. for about 1.0 hour, then cooled and solidified. The resulting solidified product was roughly pulverized to particles having particle sizes of 100 to 1,000 μm by a hammer mill to obtain the pulverizable raw material powders.

Compressed air was introduced from the compressed gas supply nozzle 2 at a flow rate "a" of 4.6 $Nm^3$/min. (6 kg/$cm^2$), and compressed secondary air was introduced from 6 positions F, G, H, J, L and M in FIG. 12 (I and K were closed) each at a flow rate "b" of 0.05 $Nm^3$/min. (6 kg/$cm^2$).

$$\frac{b}{a} = \frac{0.05 \times 6}{4.6} = 0.065$$

The pulverizable raw material powders were supplied from the raw material powder supply inlet a rate of 21 kg/hr. The pulverization product was transported to the classifying separator to withdraw the fine powders as the classified powders (pulverization product), whereas the coarse powders were returned to the acceleration pipe together with the pulverizable raw material powders from the raw material powder inlet 1. The pulverization product having a weight average particle size of 6 μm as the fine powders was recovered at a rate of 21 kg/hr.

Thus, the pulverization efficiency was improved owing to the fact that the secondary air was supplied to the acceleration pipe, the collision surface of the collision member was in a conical shape at an apex angle of 160° and the pulverization chamber was in a circular cylindrical form. Furthermore, neither fusion products nor aggregation products were formed around the collision member and the pulverization capacity was much higher than that of the conventional pulverizing system.

In case of producing fine powders having a weight average particle size of 11 μm as a pulverization product, the pulverization capacity was at a rate of 40 kg/hr.

EXAMPLE 28

The same pulverizable raw material powders as used in Example 27 were pulverized in the same manner as in Example 21 in a collision-type, gas current pulverizer having an acceleration pipe outlet with an inner diameter of 25 mm and satisfying the following conditions in FIGS. 11 and 12:

x = 80 mm y = 45 mm (y/x = 0.56), ψ = 45°

-continued

The secondary air inlets at 8 positions in the circumferential direction (6 of which were used.)

with a collision member whose collision surface was in a conical shape with an apex angle of 160°, and with a pulverization chamber of elliptical cylindrical shape (long axis: 134 mm and short axis: 96 mm) as shown in FIG. **15*b* by introducing compressed air from the compressed air supply nozzle at a flow rate of 4.6 $Nm^3$/min. (6 kg/$cm^2$) and a compressed secondary air from 6 positions F, G, H, J, L and M in FIG. 12** (I and K were closed) each at a flow rate of 0.05 $Nm^3$/min (6 kg/$cm^2$).

The pulverization product having a weight average particle size of 6 μm was recovered as fine powders at a rate of 20 kg/hr.

In case of producing fine powders having a weight average particle size of 11 μm as a pulverization product, the fine powders were obtained at a rate of 39 kg/hr. The supply rate of the pulverizable raw material powders was adjusted in accordance with the treating capacity.

EXAMPLE 29

The same pulverizable raw material powders as used in Example 27 were pulverized in the same manner as in Example 27 in a collision type, gas current pulverizer having an acceleration pipe outlet with an inner diameter of 25 mm and satisfying the following conditions in FIGS. 11 and 12:

x=80 mm, y=45 mm(y/x=0.56), ψ=60°

The secondary air inlets at 8 positions in the circumferential direction (4 of which were used)

with a collision member whose collision surface was in a conical shape with an apex angle of 120° and with a pulverization chamber of circular cylindrical shape (inner diameter: 96 mm), as shown in FIG. **15*a*, by introducing compressed air from the compressed air supply nozzle at a flow rate "a" of 4.6 $Nm^3$/min. (6 kg/$cm^2$) and compressed secondary air from 4 positions F, H, J and L in FIG. 12** (G, I, K and M were closed) each at a flow rate "b" of 0.05 $Nm^3$/min (6 kg/$cm^2$)

$$\left(b/a = \frac{0.05 \times 4}{4.6} = 0.043\right).$$

The pulverization product having a weight average particle size of 6 μm was recovered as fine powders at a rate of 17 kg/hr. The supply rate of the pulverizable raw material powders was adjusted in accordance with the treating capacity. In case of producing fine powders having a weight average particle size of 11 μm as a pulverization product, the fine powders were obtained at a rate of 34 kg/hr.

Comparative Example 13

The same pulverizable raw material powders as used in Example 27 were pulverized in a conventional collision-type, gas current pulverizer shown in FIG. 4. In the pulverizer, the collision surface 14 at the tip end of the collision member 4 was a flat surface perpendicular to the axial direction of the acceleration pipe 43, the inner diameter of the outlet 13 of the acceleration pipe was 25 mm, and the pulverization chamber was in a box form. Pulverization was carried out by supplying a compressed gas into the acceleration pipe 43 from the compressed gas supply nozzle at a flow rate of 4.6 $Nm^3/min$ (6 $kg/cm^2$), and setting the classifying separator so that fine powders as a pulverization product could have a weight average particle size of 6 μm.

The pulverized or pulverizable raw material powders colliding with the collision surface 14 were rebounded in the direction opposite to the ejecting direction of the acceleration pipe, and thus the concentration of the pulverized or pulverizable raw materials prevailing around the collision surface was considerably high. Thus, when the supply rate of the pulverizable raw material powders exceeded 4.5 kg/hr, fusion products and aggregation products started to form on the collision member, resulting in clogging in the pulverization chamber or the classifying separator with the fusion products. Thus, the treating capacity was obliged to be reduced to such a rate as 4.5 kg/hr, which was a limit to the pulverization capacity.

In case of pulverization to obtain fine powders having a weight average particle size of 11 μm as a pulverization product, fusion products and aggregation products started to form on the collision member when the supply rate of the pulverizable raw material powders exceeded a rate of 9 kg/hr, which was a limit to the pulverization capacity.

Comparative Example 14

The pulverizable raw material powders as used in Example 27 were pulverized in the same manner as in Comparative Example 13 in a collision-type, gas current pulverizer as shown in FIG. 13. The pulverizer was the same pulverizer as used in Comparative Example 13, except that the collision surface 27 at the tip end of the collision member 66 was inclined at an angle of 45° to the axial direction of the acceleration pipe 63. The pulverized or pulverizable powders colliding with the collision surface were rebounded in the leaving direction from the outlet 14 of the acceleration pipe, as compared with Comparative Example 13, and thus no fusion products nor aggregation products were formed. However, the force of collision was weaker at the collision with the collision surface, resulting in poor pulverization efficiency, and thus fine powders having a weight average particle size of 6 μm as a pulverization product were obtained only at a rate of about 4.5 kg/hr.

In case of obtaining fine powders having a weight average particle size of 11 μm as a pulverization product, the fine powders were obtained only at a rate of about 9 kg/hr.

Comparative Example 15

The same pulverizable raw material powder as used in Example 27 were pulverized in the same manner as in Comparative Example 13 in a collision-type, gas current pulverizer, the outlet 13 of whose acceleration pipe was 25 mm in the inner diameter, the collision surface of whose collision member was in a conical shape with an apex angle of 160° C. and whose pulverization chamber was in a box shape.

The pulverized or pulverizable powders colliding with the collision surface were not fused or aggregated around the collision member, because the collision surface was in a conical shape with an apex angle of 160°, and fine powders having a weight average particle size of 6 μm as a pulverization product were obtained at a rate of 11 kg/hr.

In case of obtaining fine powders having a weight average particle size of 11 μm as a pulverization product, the fine particles were produced at a rate of 29 kg/hr. However, a higher pulverization efficiency than those of Examples 1 to 3 was not obtained.

The results of Examples 27 to 29 and Comparative Examples 13 to 15 are shown in the following Tables 5-1 and 5-2.

TABLE 5-1

| | Structure of pulverizer and pulverizing conditions | | | |
|---|---|---|---|---|
| | Secondary air introduction into acceleration pipe | Shape fo collision surface of collision member | Flow rate of supplied high pressure air (including secondary air) [$Nm^3/min$] | Shape of pulverization chamber |
| Ex. 27 | Inlet angle $\psi = 45°$, 6 positions | Cone with an apex angle of 160° | 4.9 | Circular cylinder |
| Ex. 28 | Inlet angle $\psi = 45°$, 6 positions | Cone with an apex angle of 160° | 4.9 | Elliptical cylinder |
| Ex. 29 | Inlet angle $\psi = 60°$, 4 positions | Cone with an apex angle of 120° | 4.8 | Circular cylinder |
| Comp. Ex. 13 | — | Plane perpendicular to the axial direction of accelaration pipe | 4.6 | Box |
| Comp. Ex. 14 | — | Plane at an angle of 45° to the axial direction of acceleration pipe | 4.6 | Box |
| Comp. Ex. 15 | — | Cone with an apex angle of 160° | 4.6 | Box |

TABLE 5-2

| | Pluverization capacity | | | | | |
|---|---|---|---|---|---|---|
| | Production of fine powders*1) with particles size of 6 μm | | | Production of fine powders*1) with particle size of 11 μm | | |
| | Treating capacity [kg/hr] | Treating capacity per 1 $Nm^3$/min. of the flow rate of supplied high pressure air [kg/hr] | Treating *2) capacity ratio | Treating capacity [kg/hr] | Treating capacity per 1 $Nm^3$/min. of the flow rate of supplied high pressure air [kg/hr] | Treating*2) capacity ratio |
| Ex. 27 | 21 | 4.29 | 4.4 | 40 | 8.16 | 4.2 |
| Ex. 28 | 20 | 4.087 | 4.2 | 39 | 7.96 | 4.1 |
| Ex. 29 | 17 | 3.54 | 3.6 | 34 | 7.08 | 3.6 |
| Comp. Ex. 13 | 4.5 | 0.98 | 1.0 | 9 | 1.96 | 1.0 |
| Comp. Ex. 14 | 4.5 | 0.98 | 1.0 | 9 | 1.96 | 1.0 |
| Comp. Ex. 15 | 11 | 2.39 | 2.4 | 29 | 6.30 | 3.2 |

*1)Weight average particle size
*2)Treating capacity ratio per 1 $Nm^3$/min. of the flow rate of supplied high pressure air on the basis of Comp. Ex. 10 as 1.0.

EXAMPLE 30

Pulverizable raw materials were prepared from the following components:

| | | |
|---|---|---|
| Styrene-acrylic resin (MW = 200,000; Tg = 60° C.) | | 100 parts by weight |
| Magnetic powders | Magnetite, average particle size: 0.3 μm | 60 parts by weight |
| Low molecular weight polypropylene resin | | 4 parts by weight |
| Negative charge-controlling agent | | 2 parts by weight |

A mixture composed of the foregoing components as toner raw materials was melt-kneaded at about 180° C. for about 1.0 hour, then cooled and solidified. The solidified mixture was roughly pulverized to particles having particle sizes of 100 to 1,000 μm by a hammer mill to obtain the pulverizable raw material powders, which were pulverized in the same collision-type, gas current pulverizer as used in Example 27 under the same conditions as in Example 27.

Structure of the pulverizer and pulverizing conditions are summarized as follows:

| | | |
|---|---|---|
| Structure: | Acceleration pipe | Outlet inner diameter: 25 mm x = 80 mm, y = 45 mm, (y/x = 0.56) and ψ = 45° |
| | Collision member: Conical shape with a collision surface at an apex angle of 160° | |
| | Pulverization chamber: Circular cylindrical shape (inner diameter: 96 mm) | |
| Conditions: | Compressed air was introduced from the compressed gas supply nozzle at a flow rate "a" of 4.6 $Nm^3$/min (6 kg/$cm^2$); compressed secondary air was introduced from 6 positions F, G, H, J, L, and M in FIG. 12 (I and K were closed) each at a flow rate "b" of 0.05 $Nm^3$/min (6 kg/$cm^2$) $\frac{b}{a} = \frac{0.05 \times 6}{4.6} = 0.065$ | |

In case of obtaining a pulverization product having a weight average particle size of 6 μm as fine powders, the pulverization capacity was at a rate of 18.5 kg/hr. In case of obtaining a pulverization product having a weight particle size of 11 μm, the pulverization capacity was at 37 kg/hr.

EXAMPLE 31

The pulverization raw material powders as used in Example 30 were pulverized in a collision-type, gas current pulverizer with the same structure under the same conditions as in Example 28.

The structure of the pulverizer and the pulverization conditions are summarized as follows:

| | | |
|---|---|---|
| Structure: | Acceleration pipe | Outlet inner diameter: 25 mm x = 80 mm, y = 45 mm, (y/x = 0.56) and ψ = 45° |
| | Collision member: Conical shape with a collision surface at an apex angle of 160° | |
| | Pulverization chamber: Circular cylindrical shape (inner diameter: 96 mm) | |
| Conditions: | Compressed air was introduced from the compressed gas supply nozzle at a flow rate "a" of 4.6 $Nm^3$/min (6 kg/$cm^2$); compressed secondary air was introduced from 6 positions F, G, H, J, L, and M in FIG. 12 (I and K were closed) each at a flow rate "b" of 0.05 $Nm^3$/min (6 kg/$cm^2$) $\frac{b}{a} = \frac{0.05 \times 6}{4.6} = 0.065$ | |

In case of obtaining a pulverization product having a weight average particle size of 6 μm as fine powders, the pulverization capacity was at a rate of 7.5 kg/hr. In case of obtaining a pulverization product having a weight average particle size of 11 μm, the pulverization capacity was at a rate of 35 kg/hr.

EXAMPLE 32

The pulverizable raw material powders as used in Example 30 were pulverized in a collision-type, gas current pulverizer with the same structure under the same conditions as in Example 29.

The structure of the pulverizer and the pulverization conditions are summarized as follows:

| | | |
|---|---|---|
| Structure: | Acceleration pipe | Outlet inner diameter: 25 mm x = 80 mm, y = 45 mm, (y/x = 0.56) and ψ = 45° |
| | Collision member: Conical shape with a collision surface at an apex angle of 160° | |
| | Pulverization chamber: Circular cylindrical shape (inner diameter: 96 mm) | |

-continued

| | |
|---|---|
| Conditions: | Compressed air was introduced from the compressed gas supply nozzle at a flow rate "a" of 4.6 $Nm^3$/min (6 $kg/cm^2$); compressed secondary air was introduced from 6 positions F, G, H, J, L, and M in FIG. 12 (I and K were closed) each at a flow rate "b" of 0.05 $Nm^3$/min (6 $kg/cm^2$) $\frac{b}{a} = \frac{0.05 \times 4}{4.6} = 0.043$ |

In case of obtaining a pulverization product having a weight average particle size of 6 μm as fine powders, the pulverization capacity was at a rate of 15 kg/hr. In case of obtaining a pulverization product having a weight average particle size of 11 μm, the pulverization capacity was at a rate of 32 kg/hr.

Comparative Example 16

The pulverizable raw material powders as used in Example 30 were pulverized in a collision-type, gas current pulverizer with the same structure under the same conditions as in Comparative Example 13.

The structure of the pulverizer and the pulverization conditions are summarized as follows:

| | | |
|---|---|---|
| Structure: | Acceleration pipe: | Outlet inner diameter: 25 mm |
| | Collision member: | The collision surface was a plane perpendicular to the axial direction of the acceleration pipe |
| | Pulverization chamber: | box form |
| Conditions: | Compressed air was supplied from the compressed gas supply nozzle at a flow rate of 4.6 $Nm^3$/min. (6 $kg/cm^2$) | |

In case of obtaining a pulverization product having a weight average particle size of 6 μm as fine powders, the pulverization capacity was at a rate of 8 kg/hr. In case of obtaining a pulverization product having a weight average particle size of 11 μm, the pulverization capacity was at a rate of 19 kg/hr. No such phenomena that fusion products and aggregation products were formed on the collision member were observed contrary to Comparative Example 13.

Comparative Example 17

The pulverizable raw material powders as used in Example 30 were pulverized in a collision-type, gas current pulverizer with the same structure under the same conditions as in Comparative Example 14.

The structure of the pulverizer and the pulverization conditions are summarized as follows:

| | | |
|---|---|---|
| Structure: | Acceleration pipe: | Outlet inner diameter: 25 mm |
| | Collision member: | The collision surface was a plane inclined at 45° to the axial direction of the acceleration pipe. |
| | Pulverization chamber: | Box form |
| Conditions: | Compressed air was supplied from the compressed gas supply nozzle at a flow rate of 4.6 $Nm^3$/min. (6 $kg/cm^2$) | |

In case of obtaining a pulverization product having a weight average particle size of 6 μm as fine powders, the pulverization capacity was at a rate of 5 kg/hr. In case of obtaining a pulverization product having a weight average particle size of 11 μm, the pulverization capacity was at a rate of 11 kg/hr.

Comparative Example 18

The pulverizable raw material powders as used in Example 30 were pulverized in a collision-type, gas current pulverizer with the same structure under the same conditions as in Comparative Example 16.

The structure of the pulverizer and the pulverization conditions are summarized as follows:

| | | |
|---|---|---|
| Structure: | Acceleration pipe: | Outlet inner diameter: 25 mm |
| | Collision member: | Conical shape with a collision surface at an apex angle of 160° |
| | Pulverization chamber: | Box form |
| Conditions: | Compressed air was supplied from the compressed gas supply nozzle at a flow rate of 4.6 $Nm^3$/min (6 $kg/cm^2$) | |

In case of obtaining a pulverization product having a weight average particle size of 6 μm as fine powders, the pulverization capacity was at a rate of 10.5 kg/hr. In case of obtaining a pulverization product having a weight average particle size of 11 μm, the pulverization capacity was at a rate of 27 kg/hr.

As mentioned above, the pulverization efficiency could be improved in Examples 30 to 32, as compared with Comparative Examples 16 to 18. Particularly, in case of obtaining pulverization products having smaller particle sizes as fine powders, better improvement of the pulverization efficiency could be accomplished.

The results of Examples 30 to 32 and Comparative Examples 16 to 18 are shown in Tables 6-1 and 6-2.

TABLE 6-1

| | Structure of pulverizer and pulverizing conditions | | | |
|---|---|---|---|---|
| | Secondary air introduction into acceleration pipe | Shape fo collision surface of collision member | Flow rate of supplied high pressure air (including secondary air) [$Nm^3$/min] | Shape of pulverization chamber |
| Ex. 30 | Inlet angle $\psi = 45°$, 6 positions | Cone with an apex angle of 160° | 4.9 | Circular cylinder |
| Ex. 31 | Inlet angle $\psi = 45°$, 6 positions | Cone with an apex angle of 160° | 4.9 | Elliptical cylinder |
| Ex. 32 | Inlet angle $\psi = 60°$, 4 positions | Cone with an apex angle of 120° | 4.8 | Circular cylinder |

TABLE 6-1-continued

| | Structure of pulverizer and pulverizing conditions | | | |
|---|---|---|---|---|
| | Secondary air introduction into acceleration pipe | Shape fo collision surface of collision member | Flow rate of supplied high pressure air (including secondary air) [$Nm^3$/min] | Shape of pulverization chamber |
| Comp. Ex. 16 | — | Plane perpendicular to the axial direction of accelaration pipe | 4.6 | Box |
| Comp. Ex. 17 | — | Plane at an angle of 45° to the axial direction of acceleration pipe | 4.6 | Box |
| Comp. Ex. 18 | — | Cone with an apex angle of 160° | 4.6 | Box |

TABLE 6-2

| | Pulverization capacity | | | | | |
|---|---|---|---|---|---|---|
| | Production of fine powders*1) with particle size of 6 [2m | | | Production of fine powders*1) with particle size of 11 μm | | |
| | Treating capacity [kg/hr] | Treating capacity per 1 $Nm^3$/min. of the flow rate of supplied high pressure air [kg/hr] | Treating*2) capacity ratio | Treating capacity [kg/hr] | Treating capacity per 1 $Nm^3$/min. of the flow rate of supplied high pressure air [kg/hr] | Treating*2) capacity ratio |
| Ex. 30 | 18.5 | 3.78 | 2.2 | 37 | 7.55 | 1.8 |
| Ex. 31 | 17.5 | 3.57 | 2.1 | 35 | 7.14 | 1.7 |
| Ex. 32 | 15 | 3.13 | 1.8 | 32 | 6.67 | 1.6 |
| Comp. Ex. 16 | 8 | 1.74 | 1.0 | 19 | 4.13 | 1.0 |
| Comp. Ex. 17 | 5 | 1.09 | 0.6 | 11 | 2.39 | 0.6 |
| Comp. Ex. 18 | 10.5 | 2.28 | 1.3 | 27 | 5.87 | 1.4 |

*1)Weight average particle size
*2)Treating capacity ratio per 1 $Nm^3$/min. of the flow rate of supplied high pressure air on the basis of Comp. Ex. 10 as 1.0.

EXAMPLE 33

| | |
|---|---|
| Styrene-acrylic acid ester resin | 100 parts by weight |
| Magnetic powders | 70 parts by weight |
| Low molecular weight polyethylene | 6 parts by weight |
| Positive charge-controlling agent | 3 parts by weight |

Toner raw materials composed of the foregoing components in mixture was melt-kneaded by a biaxial extruder PCM-30 (made by Ikegai Tekko K.K., Japan). After cooling and solidification, the solidified product was roughly pulverized into particles having particle sizes of 0.1 to 1 mm by a mechanical pulverizing means such as a hammer mill.

The thus obtained rough pulverization product was supplied to a pulverizing system, as shown in FIG. 18 by the flow scheme, which comprised a pneumatic classifying separator as shown in FIG. 16 and a collision-type, gas current pulverizer, the collision surface of whose collision member is a conical shape with an apex angle of 160°, as shown in FIG. 9, and subjected to fine pulverization by introducing compressed air into the collision-type, gas current pulverizer from the compressed gas supply nozzle at a flow rate of 4.0 $Nm^3$/min (5 kg/$cm^2$) and compressed secondary air thereto from 6 positions F, G, H, J, L and M in FIG. 12 each at a flow rate of 0.05 $Nm^3$/min. (5.5 kg/$cm^2$), thereby obtaining a fine pulverization product having a volume average particle size of 11 μm (measured by a Coulter counter).

The particle size distribution of the thus obtained fine pulverization product had a volume average particle size of 11.0 μm, a volume frequency of 12.1% for particle sizes of less than 6.35 μm and a volume frequency of 0.6% for particle sizes of more than 20.2 μm.

The thus obtained fine pulverization product was classified by an elbow jet classifying separator (made by Nittetsu Kogyo K.K., Japan) to remove finer powders, and a classification product having a volume average particle size of 11.6 μm, a volume frequency of 2.3 % for particle sizes of less than 6.35 μm and a volume frequency of 0.9% for particle sizes of more than 20.2 μm was obtained in yield of 83% thereby. Then, 0.4% by weight of silica, based on the classification product, was added to the classification product to prepare a toner sample.

Comparative Example 19

The rough pulverization product used in Example 33 was subjected to fine pulverization in a pulverizing system comprising a conventional, gas current classifying separator, type DS-UR (made by Nihon Pneumatic Kogyo K.K. Japan) as shown in FIG. 20 and a conventional, collision-type, gas current pulverizer, Jet Mill type PJM-I (the collision surface of whose collision member was a plane perpendicular to the axial direction of the acceleration pipe), as shown in FIG. 4 by introducing a compressed air into the pulverizer at a flow rate of 4 $Nm^3$/min. (5 kg/$cm^2$) to obtain a pulverization product having a volume average particle size of 11 μm.

The capacity for fine pulverization (=supply rate of rough pulverization product) was about 0.6 times that of Example 33, and the particle size distribution of the resulting fine pulverization product was a volume average particle size of 11.1 μm, a volume frequency of 15.3% for particle sizes of less than 6.35 μm and a volume frequency of 1.3% for particle sizes of more than 20.2 μm.

The thus obtained fine pulverization product was classified by an elbow jet classifying separator to remove finer powders, and a classification product having a volume average particle sizes of 11.6 μm, a volume frequency of 2.7% for particle sizes of less than 6.35 μm and a volume frequency of 1.6% for particle sizes of more than 20.2 μm was obtained in yield of 74% thereby. Then, 0.4% by weight of silica, based on the pulverization product, was added to the classification product to prepare a toner sample.

These two toner samples prepared in Example 33 and Comparative Example 19 were subjected to copying tests using a copying machine NP-5040 (made by Canon, Japan). Duration tests were carried out each for 100,000 sheets in the ordinary atmosphere of 23° C. and 65% RH, and it was found that the toner of Example 33 had an initial image density of 1.32 and an image density of 1.37±0.03 during the duration test, showing a substantially uniform image density, and that a decrease in the density due to the supply of the toner was within 0.05 and thus the image was not influenced thereby. During the duration test, no poor cleaning nor filming, etc. were observed at all.

In case of the toner of Comparative Example 19, on the other hand, the initial image density was only 1.10 and the image density was increased to a level of 1.35±0.07 with the progress of the duration test. At the time of addition the toner, the image density was again lowered to a level of 1.05, but a considerable amount of sheets was required until a sufficient image density was obtained again. Furthermore, a poor cleaning appeared when about 30,000 sheets were copied.

Similar duration tests were carried out in a low humidity atmosphere of 15° C. and 10% RH. In case of the toner of Comparative Example 19, wavy unevenness was observed on the developing sleeve, and blank area was observed on the entire black image.

EXAMPLE 34

| | |
|---|---|
| Styrene-acrylic acid ester resin | 100 parts by weight |
| Magnetic powders | 80 parts by weight |
| Low molecular weight polyethylene | 4 parts by weight |
| Positive charge-controlling agent | 2 parts by weight |

Toner raw materials composed of the foregoing components in mixture were treated in the same manner as in Example 33 to obtain a rough pulverization product.

The thus obtained rough pulverization product was subjected to fine pulverization in the same pulverizing system as in Example 33 by introducing a compressed air into the collision-type, gas current pulverizer from the compressed gas supply nozzle at a flow rate of 4.6 $Nm^3$/min (6 kg/$cm^2$) and a compressed secondary air thereto from 6 positions F, G, H, J, L and M in FIG. 12 each at a flow rate of 0.05 $Nm^3$/min. (5.5 kg/$cm^2$), thereby obtaining a fine pulverization product having a volume average particle size of 7 μm (measured by a Coulter counter).

The particle size distribution of the thus obtained fine pulverization product had a volume average particle size of 7.0 μm, a volume frequency of 20.0% for particle sizes of less than 5.04 μm and a volume frequency of 0.4% for particle sizes of more than 12.7 μm.

The thus obtained fine pulverization product was classified by an elbow jet classifying separator and a classification product having a volume average particle size of 7.6 μm, a volume frequency of 7.5% for particle sizes of less than 5.04 μm and a volume frequency of 1.0% for particle sizes of more than 12.7 μm was obtained in yield of 79% thereby. Then, 0.6% by weight of silica, based on the classification product, was added to the classification product to prepare a toner sample.

Comparative Example 20

The rough pulverization product used in Example 34 was subjected to fine pulverization in the same conventional pulverizing system as in Comparative Example 19 by supplying a compressed air to the collision-type, gas current pulverizer at a flow rate of 4.6 $Nm^3$/min. (6 kg/$cm^a$) to obtain a fine pulverization product having a volume average particle size of 7 μm.

The capacity for fine pulverization (=supply rate of rough pulverization product) was about 0.55 times that of Example 34, and the particle size distribution of the resulting fine pulverization product was a volume average particle size of 6.9 μm, a volume frequency of 30.3% for particle sizes of less than 5.04 μm and a volume frequency of 4.7% for particle sizes of more than 12.7 μm.

The thus obtained fine pulverization product was classified by an elbow jet classifying separator and a classification product having a volume average particle sizes of 7.6 μm, a volume frequency of 7.7% for particle sizes of less than 5.04 μm and a volume frequency of 1.2% for particle sizes of more than 12.7 μm was obtained in yield of 61% thereby. Then, 0.6% by weight of silica, based on the pulverization product, was added to the classification product to prepare a toner sample.

These two toner samples prepared in Example 34 and Comparative Example 20 were subjected to copying tests using a copying machine NP-4835 (made by Canon, Japan). Duration tests were carried out each for 50,000 sheets in the ordinary atmosphere and it was found that the toner of Example 34 could maintain an initial image density of 1.38 within a range of +0.05 as an image density without any decrease in the density at the time of addition of the toner, and no such phenomena of poor cleaning and dirty image were observed at all. In case of the toner of Comparative Example 20, the initial image density was 1.20 and the image density was increased to 1.35 +0.07 with the progress of the duration test, but lowered again to 1.15 at the time of addition of toner. Poor cleaning was observed when 30,000 sheets were copied.

EXAMPLE 35

The same rough pulverization product as used in Example 34 was subjected to fine pulverization in the same pulverization system as in Example 33 by introducing a compressed air into the collision-type, gas current pulverizer from the compressed gas supply nozzle at a flow rate of 4.6 $Nm^3$/min (6 kg/$cm^2$) and a compressed secondary air thereto from 6 positions F, G, H, J, L and M in FIG. 12 each at a flow rate of 0.05 $Nm^3$/min. (5.5 kg/$cm^2$), thereby obtaining fine pulverization product having a volume average particle size of 6 μm (measured by a Coulter counter).

The particle size distribution of the thus obtained fine pulverization product had a volume average particle size of 5.9 μm, a volume frequency of 15.2% for particle sizes of less than 4.00 μm and a volume frequency of 1.5% for particle sizes of more than 10.08

The thus obtained fine pulverization product was classified by an elbow jet classifying separator and a classification product having a volume average particle size of 6.5 μm, a volume frequency of 5.3% for particle sizes of less than 4.00 μm and a volume frequency of 1.6% for particle sizes of more than 10.08 μm was obtained in yield of 75% thereby. Then, 1.2% by weight of silica, based on the classification product, was added to the classification product to prepare a toner sample.

Comparative Example 21

The rough pulverization product used in Example 34 was subjected to fine pulverization in the same conventional pulverizing system as in Comparative Example 19 by supplying a compressed air to the collision-type, gas current pulverizer at a flow rate of 4.6 $Nm^3$/min. (6 $kg/cm^a$) to obtain a fine pulverization product having a volume average particle size of 6 μm .

The capacity for fine pulverization (=supply rate of rough pulverization product) was about 0.5 times that of Example 35, and the particle size distribution of the resulting fine pulverization product was a volume average particle size of 6.2 μm, a volume frequency of 15.8% for particle sizes of less than 4.00 μm and a volume frequency of 3.3% for particle sizes of more than 10.08 μm.

The thus obtained fine pulverization product was classified by an elbow jet classifying separator and a classification product having a volume average particle sizes of 6.7 μm, a volume frequency of 5.6% for particle sizes of less than 4.00 μm and a volume frequency of 2.4% for particle sizes of more than 10.08 μm was obtained in yield of 65% thereby. Then, 1.2% by weight of silica, based on the pulverization product, was added to the classification product to prepare a toner sample.

These two toner samples prepared in Example 35 and Comparative Example 21 were subjected to copying tests using a copying machine NP-4835 (made by Canon, Japan). Duration tests were carried out each for 50,000 sheets in the ordinary atmosphere and it was found that the toner of Example 35 could maintain an initial image density of 1.25 within a range of ±0.05 as an image density without any decrease in the density at the time of addition of the toner, and no such phenomena of poor cleaning and dirty image were observed at all. In case of the toner of Comparative Example 21, on the other hand, the initial image density was 1.05 and the image density was increased to 1.20±0.07 with the progress of the duration test, but lowered again to 1.05 at the time of addition of toner. Poor cleaning was observed when 20,000 sheets were copied.

Further in a low humidity atmosphere fogging appeared in case of the toner of Comparative Example 21, as compared with Example 35.

As described above, in the present process for producing a toner, a toner for developing an electrostatically charged image can be obtained at a low cost with a high and stable image density and a good durability without image defects such as fogging, poor cleaning, etc. Furthermore, a toner with much smaller particle size for developing an electrostatically charged image can be effectively obtained.

We claim:

1. A process for producing a toner for developing an electrostatic image, comprising the steps of:

kneading a composition containing at least a binder resin and a coloring agent under fusion;

cooling and solidifying the composition, and pulverizing the solidified composition with a collision-type gas current pulverizer, wherein the collision-type gas current pulverizer includes an acceleration pipe for transporting powders under acceleration by a high pressure gas, a pulverization chamber, a collision member for pulverizing the powders ejected from the acceleration pipe by a collision force, with the collision member being provided against the outlet of the acceleration pipe, a raw material powder supply inlet provided at the acceleration pipe, and a secondary air inlet provided between the raw material powder supply inlet and the outlet of the acceleration pipe, with secondary air being introduced into the acceleration pipe from the secondary air inlet.

2. The process according to claim 1, further comprising the step of forming a collision surface of the collision member with a conical tip end having an apex angle of 110° to less than 180°.

3. The process according to claim 1, wherein the secondary air inlet for introducing secondary air into the acceleration pipe is provided at a position downstream from where the raw material enters the acceleration pipe and upstream from the outlet of the acceleration pipe.

4. The process according to claim 1, wherein a distance x between the raw material powder supply inlet provided on the acceleration pipe and the outlet of the acceleration pipe and a distance y between the raw material powder inlet and the secondary air inlet satisfy the following correlation:

$$0.2 \leqq \frac{y}{x} \leqq 0.9.$$

5. The process according to claim 1, wherein an inlet angle ψ of a passage defining the secondary air inlet provided on the acceleration pipe satisfies the following correlation to the axial direction of the acceleration pipe:

$$10° \leqq \psi \leqq 80°.$$

6. The process according to claim 1, wherein the acceleration pipe is in a laval-type form.

7. The process according to claim 1, wherein the acceleration pipe is in an ejector-type form.

8. The process according to claim 1, wherein a tip end of the collision member is in a conical form with an apex angle of at least 110° but less than 180°, and the pulverization chamber is in either one of circular and elliptical form having a center axis in the axial direction of the acceleration pipe.

9. The process according to claim 1, wherein a flow rate "a" $Nm^3$/min. of the high pressure gas for transporting the powders introduced into the acceleration pipe under acceleration and a flow rate "b" $Nm^3$/min. of the secondary air introduced into the acceleration pipe satisfy the following correlation:

$$0.001 \leqq \frac{b}{a} \leqq 0.5.$$

10. The process according to claim 1, further comprising the steps of providing the collision member with a tip end in a conical form with an apex angle of at least 110° but less than 180° to pulverize the powder colliding with the collision member; and permitting the pulverized product resulting from the collision to undergo secondary collision with walls of the pulverization chamber, thereby further pulverizing the powder.

11. The process according to claim 1, wherein the solidified composition is first pulverized by a mechanical pulverizer before being pulverized by the collision-type gas current pulverizer.

12. A process for producing a toner for developing an electrostatic image using a gas current classifying separator including a powder inlet cylinder, an annular guide chamber in communication with the powder inlet cylinder, a classification chamber, a plurality of louvers provided between the guide chamber and the classification chamber, with ends of the individual louvers arranged in a tangential direction toward an inner peripheral circle of the guide chamber, an inclined classifying plate provided at the bottom of the classification chamber, the inclined classifying plate being elevated towards the center and having a discharge outlet at the center, a plurality of classifying louvers provided at the bottom of the classification chamber and around the inclined classifying plate, a fine powder discharge chute connected to the discharge outlet, and a coarse powder discharge outlet provided around and at the bottom of the classifying plate, and using a collision-type gas current pulverizer including an acceleration pipe for transporting powders under acceleration by a high pressure gas, a pulverization chamber, a collision member for pulverizing the powders ejected from the acceleration pipe by a collision force, the collision member being provided against the outlet of the acceleration pipe, a raw material powder supply inlet being provided at the acceleration pipe, and a secondary air inlet being provided between the raw material powder supply inlet and the outlet of the acceleration pipe, said method comprising the steps:

kneading a composition containing at least a binder resin and a coloring agent under fusion;

cooling and solidifying the composition;

first pulverizing the solidified composition with a mechanical pulverizer to form a first pulverized product;

secondly pulverizing the first pulverized product with the collision-type gas current pulverizer to form a second pulverized product;

classifying the second pulverized product into fine powders and coarse powders using the gas current classifying separator;

withdrawing the classified fine powders from the classifying separator to obtain a toner; and introducing the classified coarse powders back into the collision-type gas current pulverizer with additional first pulverized product, wherein the second pulverized product is classified in the gas current classifying separator by the following steps:

supplying the second pulverized product with transporting air into the classification chamber to be subjected to a whirling flow by an air stream introduced through the classifying louvers so as to centrifugally separate the second pulverized product into fine powders and coarse powders;

discharging fine powders through the fine powder discharge chute; and discharging the coarse powders through the coarse powder discharge outlet.

13. The process according to claim 12, further comprising the step of forming a collision surface of the collision member with a conical tip end having an apex angle of 110° to less than 180°.

14. The process according to claim 12, wherein the secondary air inlet for introducing secondary air into the acceleration pipe is provided at a position downstream from where the raw material enters the acceleration pipe and upstream from the outlet of the acceleration pipe.

15. The process according to claim 12, wherein a distance x between the raw material powder supply inlet provided on the acceleration pipe and the outlet of the acceleration pipe and a distance y between the raw material powder inlet and the secondary air inlet satisfy the following correlation $$0.2 \leqq \frac{y}{x} \leqq 0.9.$$

16. The process according to claim 12, wherein an inlet angle $\psi$ of a passage defining the secondary air inlet provided on the acceleration pipe satisfies the following correlation to the axial direction of the acceleration pipe:

$$10° \leqq \psi \leqq 80°.$$

17. The process according to claim 12, wherein the acceleration pipe is in a laval-type form.

18. The process according to claim 12, wherein the acceleration pipe is in an ejector-type form.

19. The process according to claim 12, wherein a tip end of the collision member is in a conical form with an apex angle of at least 110° but less than 180°, and the pulverization chamber is in either one of circular and elliptical form having a center axis in the axial direction of the acceleration pipe.

20. The process according to claim 12, wherein a flow rate "a" $Nm^3$/min. of the high pressure gas for transporting the powders introduced into the acceleration pipe under acceleration and a flow rate "b" $Nm^3$/min. of the secondary air introduced into the acceleration pipe satisfy the following correlation:

$$0.001 \leqq \frac{b}{a} \leqq 0.5.$$

21. The process according to claim 12, further comprising the steps of providing the collision member with a tip end in a conical form with an apex angle of at least 110° but less than 180° to pulverize the powder colliding with the collision member; and permitting the pulverization product resulting from the collision to undergo secondary collision with walls of the pulverization chamber, thereby further pulverizing the powder.

* * * * *

UNITED STATES PATENT AND TRADEMARK OFFICE

CERTIFICATE OF CORRECTION

PATENT NO. : 5,435,496 Page 1 of 3

DATED : July 25, 1995

INVENTOR(S) : Kanda et al.

It is certified that error appears in the above-indentified patent and that said Letters Patent is hereby corrected as shown below:

COLUMN 7:

Line 42, "001 $\leq b/a \leq$ 0.4" should read --0.01 $\leq b/a \leq$ 0.4--.

COLUMN 11:

Line 50, "is communication" should read --is in communication--.

COLUMN 15:

Line 20, "(19 kg/hr.," should read --19 kg/hr.,--.

COLUMN 17:

Line 68, "0.1Nm$^{3/min.}$" should read --0.1Nm$^3$/min.--.

COLUMN 28:

Line 10, "[M" should read --M--.

COLUMN 30:

Line 21, "angle" should read --angle of 160°--.
Line 23, "angle" should read --angle of 120°--.
Line 26, "angle" should read --angle of 160°--.
Line 65, "(partio size: 0.3μm)" should read --particle size: 0.3μm--.

COLUMN 34:

Line 1, "TABLE 3-1" should read --TABLE 4-1--.

UNITED STATES PATENT AND TRADEMARK OFFICE

CERTIFICATE OF CORRECTION

PATENT NO. : 5,435,496

DATED : July 25, 1995

INVENTOR(S) : Kanda et al.

It is certified that error appears in the above-indentified patent and that said Letters Patent is hereby corrected as shown below:

Line 10, "angle" should read --angle of 160°--.
Line 12, "angle" should read --angle of 120°--.
Line 15, "angle" should read --angle of 160°--.
TABLE 4-2, "3.167" should read --3.16--.

COLUMN 35:

Line 36, "inlet a" should read --inlet 1 at a--.

COLUMN 39:

TABLE 5-2, "4.087" should read --4.08--.
TABLE 5-2, "size" should read --size (measured by Coulter counter)--.

COLUMN 40:

Lines 33-35, "Circular cylindrical shape (inner diameter: 96mm)" should read --Elliptical cylindrical shape long axis: 134mm; short axis: 96mm--.
Line 46, "7.5 kg/hr." should read --17.5 kg/hr.--.
Line 63, "$\psi$ = 45°" should read --$\psi$ = 60°--.
Line 66, "160°" should read --120°--.

COLUMN 41:

Line 2, "introduced" should read --supplied--.
Line 5, "introduced" should read --supplied--.
Lines 6 and 7, "from 6 positions F, G, H, J, L, and M in Fig. 12 (I and K were closed)" should read --from 4 positions F, H, J, L, (G, I, K and M were closed) in Fig. 12--.

UNITED STATES PATENT AND TRADEMARK OFFICE

CERTIFICATE OF CORRECTION

PATENT NO. : 5,435,496 Page 3 of 3

DATED : July 25, 1995

INVENTOR(S) : Kanda et al.

It is certified that error appears in the above-indentified patent and that said Letters Patent is hereby corrected as shown below:

COLUMN 42:

Line 60, "fo" should read --of--.

COLUMN 43:

Line 33, "size" should read --size (measured by Coulter counter)--.
Line 34, "Comp. Ex. 10" should read --Comp. Ex. 16--.

COLUMN 46:

Line 68, "10.08" should read --10.08μm.--.

COLUMN 47:

Line 17, "kg/cm²)" should read --kg/cm²)--.

COLUMN 48: Line 3, "wherein the" should read--providing a--.

Signed and Sealed this

Twenty-seventh Day of February, 1996

*Attest:*

BRUCE LEHMAN

*Attesting Officer*

*Commissioner of Patents and Trademarks*